US006019371A

United States Patent [19]

Mantis

[11] Patent Number: 6,019,371

[45] Date of Patent: Feb. 1, 2000

[54] ENVIRONMENTAL BOARD GAME

[76] Inventor: Nicholas J. Mantis, 9843 Olcott Ave., St. John, Ind. 46373

[21] Appl. No.: 09/112,100

[22] Filed: Jul. 9, 1998

[51] Int. Cl.[7] ..... A63F 3/00

[52] U.S. Cl. ..... 273/256; 273/243

[58] Field of Search ..... 273/256, 242, 273/243, 248, 249, 278

[56] References Cited

U.S. PATENT DOCUMENTS

| | | | |
|---|---|---|---|
| 2,026,082 | 12/1935 | Darrow . | |
| 3,740,038 | 6/1973 | Feulner . | |
| 3,850,433 | 11/1974 | Purlia . | |
| 4,162,075 | 7/1979 | Iannucci . | |
| 4,279,422 | 7/1981 | Shaw | 273/256 |
| 4,386,778 | 6/1983 | Hall | 273/256 |
| 4,501,425 | 2/1985 | Alvarado . | |
| 4,915,391 | 4/1990 | Aharonian | 273/256 |
| 4,961,584 | 10/1990 | Day, Sr. . | |
| 5,007,650 | 4/1991 | Reed et al. . | |
| 5,071,135 | 12/1991 | Campbell | 273/256 |
| 5,088,739 | 2/1992 | Mitchell . | |
| 5,193,814 | 3/1993 | Koch . | |
| 5,407,207 | 4/1995 | Stanford . | |
| 5,503,399 | 4/1996 | Honeywill | 273/256 X |
| 5,547,198 | 8/1996 | Kaiser . | |
| 5,660,389 | 8/1997 | Freda, III | 273/249 |
| 5,782,471 | 7/1998 | Bautista et al. | 273/256 |
| 5,810,359 | 9/1998 | Wilkins et al. | 273/256 |

*Primary Examiner*—William E. Stoll
*Attorney, Agent, or Firm*—Robert Toczycki

[57] ABSTRACT

A board game having an environmental theme named after "Superfund". This board game simulates environmental cleanup efforts of hazardous and other abandoned dump sites facing world-wide industry. Players take on the role of a company's chief executive officer (CEO). Playing the role of CEO, player's will manage a company by making corporate decisions as they relate to the Superfund. These corporate decisions are based on the company's profitability and environmental compliance efforts. The game incorporates elements engaged by industry, government, special interest and the community in regards to environmental cleanup of toxic and other waste dumps left abandoned for decades. Players will deal with the community, Environmental Protection Agency, lawyers and other companies. The Superfund game board contains playing routes in which players move along to reach the end of the fiscal year. Each of the playing squares dictate the playing scenarios which player's will play-out. Players will rely on strategic decisions, chance and/or luck throughout the fiscal year. After all the players have finished the fiscal year and participated in Superfund cleanup, the player with the most money left in their possession, will be declared the winner.

15 Claims, 23 Drawing Sheets

58

| | | |
|---|---|---|
| **EPA**<br>Unannounced Plant Inspection!<br>LOSE NEXT TURN! | **EPA**<br>Environmental Progress!<br>EXTRA DICE TOKEN | **EPA**<br>"CLEAN UP THE MESS!"<br>PAY $5 MILLION! |
| **EPA**<br>Environmental Compliance!<br>MOVE/PLAY NEXT SQUARE! | **EPA**<br>Swifter Enforcement Action!<br>MOVE BACK THREE SPACES! | **EPA**<br>Unclear Definition Of Clean!<br>LAWYER CARD! |
| **EPA**<br>EPA Lends A Helping Hand!<br>ALTERNATIVE ENERGY! | **EPA**<br>Underground Tank Removal!<br>PAY $2 MILLION! | **EPA**<br>Voluntary Cleanup!<br>EXTRA DICE TOKEN! |
| **EPA**<br>Polluted Soil Samples!<br>PAY $4 MILLION! | **EPA**<br>SUPERFUND Delays!<br>ROLL AGAIN! | **EPA**<br>Cleanup Guidelines!<br>INSURANCE TOKEN! |
| **EPA**<br>Increased Cleanup Cost!<br>PAY $3 MILLION! | **EPA**<br>Improper Chemical Storage!<br>PAY $4 MILLION! | **EPA**<br>Mysterious Pipeline Discovered!<br>GO TO LIT PIT! |
| **EPA**<br>Energy Conservation Program!<br>RECEIVE $2 MILLION! | **EPA**<br>Illegal Night Time Emission!<br>PAY $6 MILLION! | **EPA**<br>Pollution Prevention Plan!<br>INSURANCE TOKEN! |
| **EPA**<br>Environmental Research!<br>RECEIVE $3 MILLION! | **EPA**<br>New Laws And Regulations!<br>COUNTERSUIT TOKEN! | **EPA**<br>Placed On Polluters List!<br>GO TO LIT PIT! |
| **EPA**<br>Criminal Charge For Polluters!<br>LOSE NEXT TURN! | **EPA**<br>Variance For Water Emissions!<br>MOVE/PLAY NEXT SQUARE! | **EPA**<br>Taxpayer Money For Cleanup!<br>EXTRA DICE TOKEN! |

*FIG. 7*

60

| | | |
|---|---|---|
| **LAWYER**<br>Contract With New Lawyers!<br>COUNTERSUIT TOKEN! | **LAWYER**<br>Cleanup Discussions!<br>LOSE NEXT TURN! | **LAWYER**<br>Lawyers Win Decision!<br>RECEIVE $4 MILLION! |
| **LAWYER**<br>Umbrella Insurance Coverage!<br>INSURANCE TOKEN! | **LAWYER**<br>SUE ANY PLAYER OF YOUR CHOOSING! | **LAWYER**<br>Legal Setback!<br>PAY $4 MILLION! |
| **LAWYER**<br>Legal Fees!<br>PAY $2 MILLION! | **LAWYER**<br>Case Delayed!<br>MOVE/PLAY NEXT SQUARE! | **LAWYER**<br>Case Thrown Out Of Court!<br>MOVE UP FOUR SPACES! |
| **LAWYER**<br>Top Notch Lawyers!<br>COUNTERSUIT TOKEN! | **LAWYER**<br>Lawyers Lose Motion!<br>GO TO LIT PIT! | **LAWYER**<br>Variance On Company Permits!<br>ALTERNATIVE ENERGY! |
| **LAWYER**<br>Judge Extends Case!<br>ROLL AGAIN! | **LAWYER**<br>Late Court Filing!<br>LOSE NEXT TURN! | **LAWYER**<br>Lawyers File Motion!<br>PAY $3 MILLION! |
| **LAWYER**<br>Lost Environmental Ruling!<br>MOVE BACK THREE SPACES! | **LAWYER**<br>Environmental Loophole!<br>FREE DICE TOKEN! | **LAWYER**<br>Motion For New Evidence!<br>ROLL AGAIN! |
| **LAWYER**<br>Legal Dispute With Bankers!<br>PAY $4 MILLION! | **LAWYER**<br>Motion For Time Extension!<br>MOVE UP THREE SQUARES! | **LAWYER**<br>Permit Violations!<br>LOSE NEXT TURN! |
| **LAWYER**<br>Legal Status Is Very Grim!<br>LOSE NEXT TWO TURNS! | **LAWYER**<br>Lawyers Miss Important Filing!<br>LOSE NEXT TWO TURNS! | **LAWYER**<br>Aggresive Legal Tactics!<br>ROLL AGAIN! |

*FIG. 8*

62

| | | |
|---|---|---|
| **CORPORATE**<br>Delayed Record Of Decision!<br>ROLL AGAIN! | **CORPORATE**<br>Corporate Merger!<br>COUNTERSUIT TOKEN! | **CORPORATE**<br>Toxic Waste Cleanup!<br>MOVE BACK THREE SPACES! |
| **CORPORATE**<br>MOVE STOCK MARKER UP THREE POINTS! | **CORPORATE**<br>Achievement Award!<br>INSURANCE TOKEN! | **CORPORATE**<br>Train Derailment!<br>PAY $2 MILLION! |
| **CORPORATE**<br>Quick Cleanup Response!<br>ROLL AGAIN! | **CORPORATE**<br>Positive Meeting With EPA!<br>INSURANCE TOKEN! | **CORPORATE**<br>RECEIVE OR PAY CURRENT STOCK VALUE! |
| **CORPORATE**<br>Pollution Inspection Cutbacks!<br>MOVE/PLAY NEXT SQUARE! | **CORPORATE**<br>Environmental Compliance!<br>ALTERNATIVE ENERGY! | **CORPORATE**<br>Pollution Control Equipment!<br>PAY $3 MILLION! |
| **CORPORATE**<br>Conservative Program!<br>PAY $3 MILLION! | **CORPORATE**<br>DROP STOCK MARKER DOWN THREE POINTS! | **CORPORATE**<br>Anti-Pollution Program!<br>RECEIVE $3 MILLION! |
| **CORPORATE**<br>Cleanup Strategy is Rejected!<br>LOSE NEXT TURN! | **CORPORATE**<br>Cheaper Hauling Cost!<br>ROLL/PLACE BARRELS IN PIT! | **CORPORATE**<br>Push For Production!<br>ROLL AGAIN! |
| **CORPORATE**<br>Workers Prevent Pollution!<br>FREE DICE TOKEN! | **CORPORATE**<br>Pollution Decrease!<br>RECEIVE $4 MILLION | **CORPORATE**<br>Bankers Refuse Funding!<br>LOSE NEXT TURN! |
| **CORPORATE**<br>Environmental Award!<br>RECEIVE $5 MILLION! | **CORPORATE**<br>Recycling Training!<br>PAY $2 MILLION! | **CORPORATE**<br>Plant Cleanup!<br>LOSE NEXT TURN! |

*FIG. 9*

64

| | | |
|---|---|---|
| **COMMUNITY**<br>Successful Recycling Program!<br>RECEIVE $3 MILLION! | **COMMUNITY**<br>Bad Press Of Company!<br>MOVE/PLAY NEXT SQUARE! | **COMMUNITY**<br>Pictures Of Pollution!<br>LOSE NEXT TURN! |
| **COMMUNITY**<br>Pollution Prevention Programs!<br>ROLL AGAIN! | **COMMUNITY**<br>Taxes Pay For Lawsuits!<br>PAY $5 MILLION! | **COMMUNITY**<br>Hazardous Waste Collection!<br>MOVE/PLAY NEXT SQUARE! |
| **COMMUNITY**<br>New Water Treatement Plant!<br>INSURANCE TOKEN! | **COMMUNITY**<br>Ecological Study!<br>PAY $2 MILLION! | **COMMUNITY**<br>New Air Emission System!<br>ROLL AGAIN! |
| **COMMUNITY**<br>Environmental Scholarships!<br>ALTERNATIVE ENERGY! | **COMMUNITY**<br>Environmental Awareness!<br>FREE DICE TOKEN! | **COMMUNITY**<br>Insurance Rates Increase!<br>INSURANCE TOKEN! |
| **COMMUNITY**<br>Conserve, Preserve And Restore Then Earth!<br>ROLL AGAIN! | **COMMUNITY**<br>Abandoned Barrels In Field!<br>GO TO LIT PIT! | **COMMUNITY**<br>Community Rewards Company With ANY TOKEN! |
| **COMMUNITY**<br>Environmental Essay Contest!<br>RECEIVE $2 MILLION! | **COMMUNITY**<br>Forestry Research!<br>RECEIVE ANY TOKEN! | **COMMUNITY**<br>Company Tax Break!<br>RECEIVE $4 MILLION! |
| **COMMUNITY**<br>Corporate Environmental Award!<br>ROLL AGAIN! | **COMMUNITY**<br>Cleanup Of Polluted Rivers!<br>PAY $4 MILLION! | **COMMUNITY**<br>Biological Research!<br>RECEIVE $2 MILLION! |
| **COMMUNITY**<br>Legal Defense Fund!<br>COUNTERSUIT TOKEN! | **COMMUNITY**<br>Community Tree Planting!<br>MOVE UP TWO SPACES! | **COMMUNITY**<br>Public Park Restoration!<br>ROLL AGAIN! |

*FIG. 10*

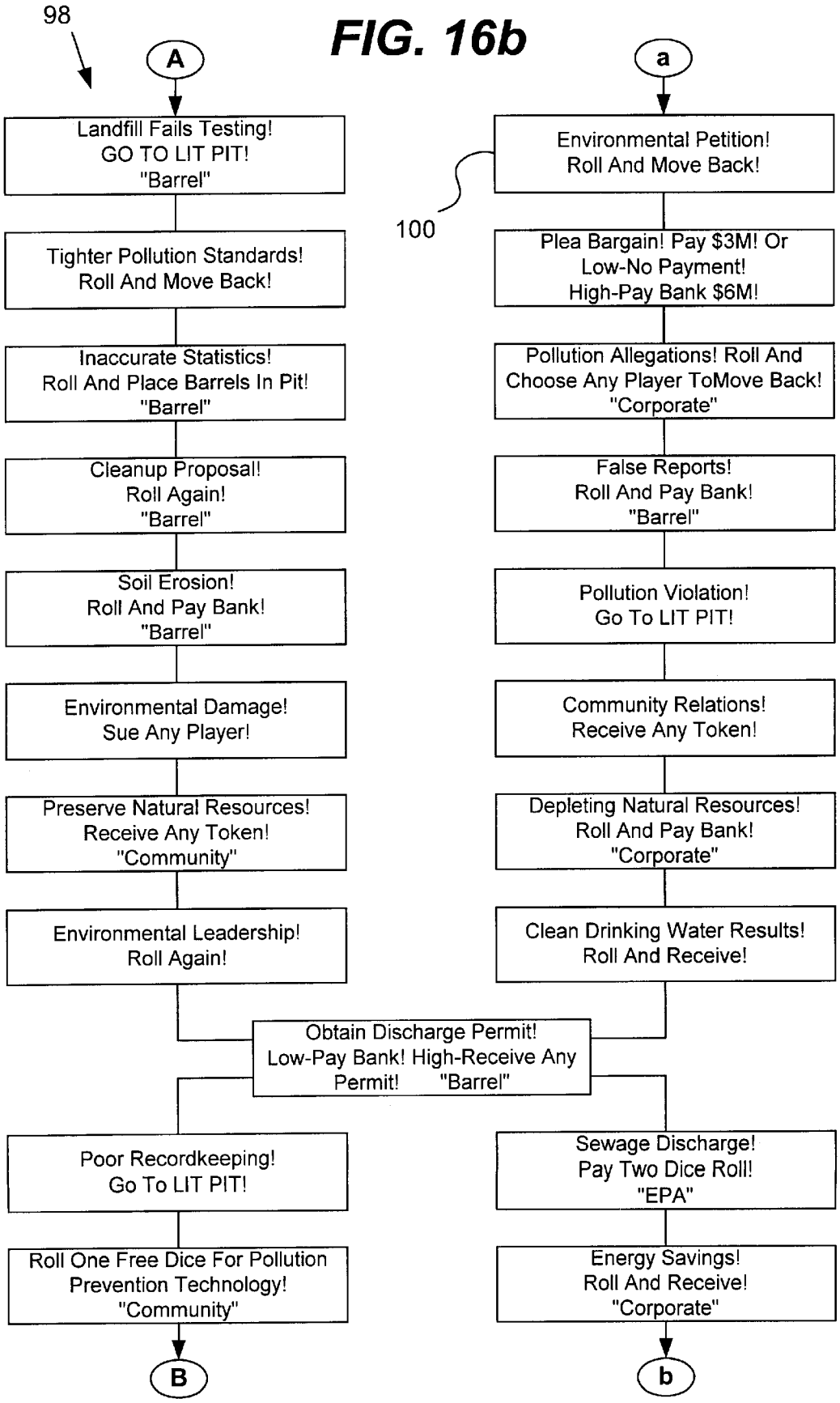
98
FIG. 16b
A
a
Landfill Fails Testing! GO TO LIT PIT! "Barrel"
Tighter Pollution Standards! Roll And Move Back!
Inaccurate Statistics! Roll And Place Barrels In Pit! "Barrel"
Cleanup Proposal! Roll Again! "Barrel"
Soil Erosion! Roll And Pay Bank! "Barrel"
Environmental Damage! Sue Any Player!
Preserve Natural Resources! Receive Any Token! "Community"
Environmental Leadership! Roll Again!
Environmental Petition! Roll And Move Back!
100
Plea Bargain! Pay $3M! Or Low-No Payment! High-Pay Bank $6M!
Pollution Allegations! Roll And Choose Any Player ToMove Back! "Corporate"
False Reports! Roll And Pay Bank! "Barrel"
Pollution Violation! Go To LIT PIT!
Community Relations! Receive Any Token!
Depleting Natural Resources! Roll And Pay Bank! "Corporate"
Clean Drinking Water Results! Roll And Receive!
Obtain Discharge Permit! Low-Pay Bank! High-Receive Any Permit! "Barrel"
Poor Recordkeeping! Go To LIT PIT!
Roll One Free Dice For Pollution Prevention Technology! "Community"
Sewage Discharge! Pay Two Dice Roll! "EPA"
Energy Savings! Roll And Receive! "Corporate"
B
b

ENVIRONMENTAL BOARD GAME

BACKGROUND OF THE INVENTION

This invention relates generally to board games and more particularly to a board game placing emphasis on the various environmental cleanup issues facing corporations, the U.S. government, including the Environmental Protection Agency (EPA), communities and the environment.

The present invention deals with board games of the type in which players roll a dice to move their playing piece along a playing route consisting of playing squares. Players will play with issues involving fiscal responsibilities and environmental compliance in regards to the demands being made by government and communities to cleanup decades of polluted and abandoned dump sites.

The term Superfund refers to an actual EPA sponsored program. It derives from the EPA's Comprehensive Environmental Response, Compensation & Liability Act (CERCLA). CERCLA deals primarily with abandoned dumps and other contaminated waste sites. It also created strict joint and several liability for polluters. CERCI,A created record keeping and reporting requirements for industry. The Superfund amendments Re-Authorization Act (RCRA) created response and liability issues levied upon industry in efforts for creating a polluters pay enforcement approach by the U.S. government. The current direction of Superfund is the prospect of natural resource damage liability. This is creating a whole new era of public policy debates and creates more legal turmoil.

Corporations have been battling long and expensive litigation that has gone on for decades. The EPA has allocated tens of billions of tax payer dollars into Superfund, making it the EPA's most expensive environmental program. Superfund was intended to cleanup the tens of thousands of hazardous and other abandoned, polluted sites created from nearly a century of industrial disposal abuse of pollutants into the environment.

Corporations have spent in the "hundred of billions" of dollars in remediation studies and litigation. The result of nearly two decades of Superfund is that the environment has been left with very little actual cleanup of those tens of thousands of polluted sites. These sites, (over 36,000), had been identified for cleanup by the EPA for nearly two decades. Presently, Superfund has been a dismal failure for all parties involved.

Thus, it is an object of this invention to provide a game board apparatus that will offer players the chance to role-play, as the CEO of their own company, to guide their company for an entire fiscal year, while confronting the same issues facing corporations, the government, and communities, and the methods of enforcement. The strategy is to keep their company profitable while complying with the regulatory demands of environmental cleanup, required by Superfund and other environmental regulations.

SUMMARY OF THE INVENTION

The present invention provides a board game apparatus that will offer opportunities of corporate decision-making for the players to play-out through a fiscal year of corporate finance and environmental compliance. This board game has incorporated many of the actual demands and issues that have been placed upon the activities of corporate responsibilities of cleaning up the tens of thousands of contaminated and other abandoned hazardous dump sites. As such, the general purpose of the present invention will be to present the ideas of the corporate role of cleaning up the environment, as well as managing the legal strategies being employed through legal enforcement. Parties with a special interest in Superfund include: communities, corporations, federal, state and local government, scientists and lawyers.

For different players, different strategies and priorities will exist. Some will opt for keeping a low profile and attempt to play quietly through the fiscal year. Others may opt for attempts to obtain pollution prevention Technologies hoping to enhance their pollution reduction and increase potential profitability. There will also be times when players will find themselves in unforeseeable situations as well as contributing to the polluting of Superfund.

The board game intends to allow players to take charge of their own company and manage it through a fiscal year. The object of the game is to make sound decisions that will keep the company in compliance of environmental regulations with minimal degrees of cleanup cost and stagnate litigation in the courts.

A strategy of the Superfund would be to guide the company into situations that would cost the company the least amount of monies, board game space, lawsuits, stock points, pollution or playing turns. This would lessen the burdens of the players having to pay out these monies. Instead, being able to save it for total profits for the end of the fiscal year, competing to become the game's winner.

This may be done by taking advantage of optional routes. Optional routes are those sections of the playing route that splits into two (2) different routes, offering the player two (2) different options for the player. The longer routes have less severe penalties and may possibly offer a player an opportunity to benefit the company. The drawback is that it may take longer to complete the route, possibly placing the player behind the other players. The shorter routes are riskier in terms of chances, however, the shorter routes could pay off handsomely or penalize severely. The added benefit to shorter routes is that it may be a quicker route to finish.

Players will be entertained by the decisions they will make as well as the chances of luck. The game encourages environmental compliance through the playing out of expensive litigation, pollution, compliance and cleanup.

DESCRIPTION OF THE DRAWINGS

FIG. 7 illustrates the various EPA playing cards that players will receive when landing on certain playing squares;

FIG. 8 illustrates the various lawyer playing cards that players will receive when landing on certain playing squares;

FIG. 9 illustrates the various corporate playing cards that players will receive when landing on certain playing squares;

FIG. 10 illustrates the various community playing cards that players will receive when landing on certain playing squares;

FIG. 16*b* illustrates the board game's playing path continued from FIG. 16*a;*

FIG. 16*l* illustrates the board game's playing path continued from FIG. 16*k;*

DETAILED DESCRIPTION OF THE PREFERRED EMBODIMENT

Figure 1:
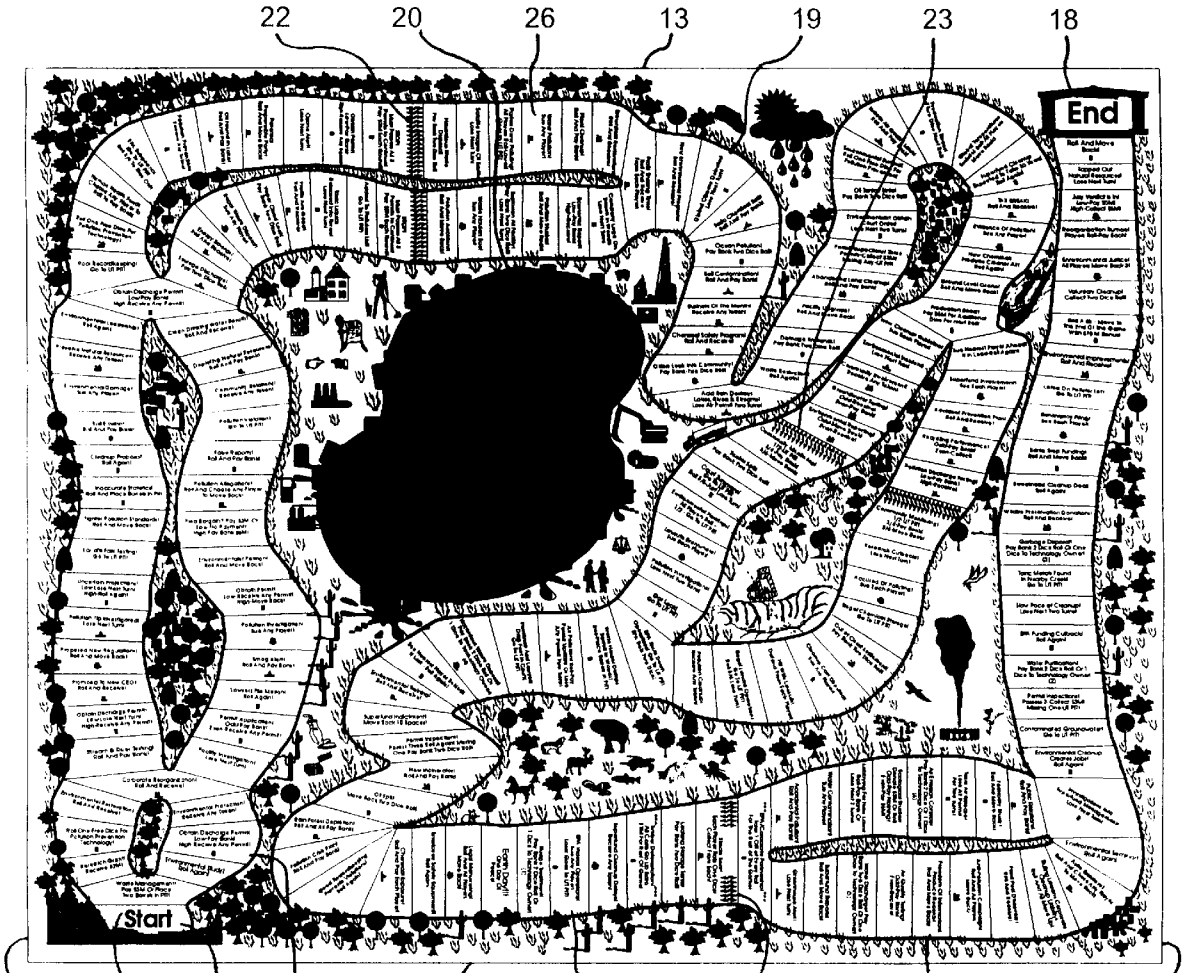
FIG. 1 illustrates a plan view of my Superfund board game playing surface.

Referring more particular to the drawings, FIG. 1 illustrates a playing board which is indicated generally by the reference numeral 10. The board 10 may be fabricated of any suitable material, with a good grade of cardboard being preferred, as is customary in games of the instant type. The board 10 is preferably of square configuration having four outer side edges 11, 12, 13, 14 and a playing surface 15.

The playing surface 15 includes the entire embodiment of the game's playing surface. Briefly describing the playing surface 15, the surface will consist of a Start 16 and a Finish 18 with a playing route 19 that curves and weaves from singular into separate playing routes. Also included on the game board's playing surface is a Superfund and a Litigation Pit or LIT PIT 20 and Fiscal Quarter markings 22, 23, 24.

The playing method of Superfund, is for players to take their playing piece and guide it through the playing surface containing the playing routes. The playing routes are essential to the direction a player may wish to guide their company through. The routes themselves contain the playing squares 26, which offer the player the potential playing scenario they will need to play out. On the singular routes, players will land on playing squares without any other routes or playing scenarios offered, however, on the split routes, players will have the option of accepting a possible playing scenario from one route, while possibly accepting the playing scenario on another playing route. Generally, the longer routes will consist of playing scenarios containing lesser demands from the player's company. The shorter routes, will generally offer scenarios that are a more riskier. The risks included may consist of potential profits beneficial to the player's company or stiffer penalties and liabilities. All playing routes, after splitting up into two separate routes, are designed to reconnect again to form a singular route. These routes follow along a slated schedule of equally proportioned fiscal quarters. There are four fiscal quarters that embody the entire fiscal year.

The Start 16 lies in the general vicinity on one corner of the playing board 10. The End 18 lies in the opposite corner as the Start. The four fiscal quarters lie between the Start 16 and the End 17 on the weaving and curving playing routes 19.

Near the center of the playing surface 10 lies the Superfund and the Litigation Pit 20, otherwise known as the LIT PIT. The Superfund 20 serves the purpose of storing and holding all Leaking Barrels that players will place into it. It becomes the LIT PIT 20 when players are engaged in legal battles with the Environmental Protection Agency (EPA), wherein players place their playing piece into the LIT PIT.

Figure 2:
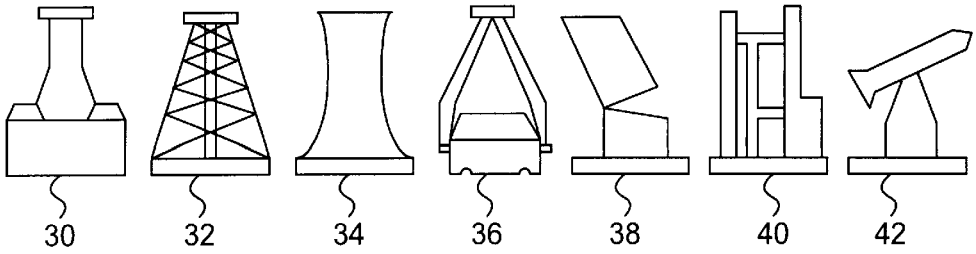
FIG. 2 illustrates the player figures used in my board game, wherein the figures will be in the shapes representing a particular industry (steel, oil, energy, chemical, auto, timber, armed forces)

FIG. 2 illustrates the playing pieces that are used in the game. The first playing piece 30 is represented in the shape of a Steel Mill. The second playing piece 32 is represented in the shape of an Oil Refinery. The third playing piece 34 is represented in the shape of a Utility/Nuclear Plant. The fourth playing piece 36 is represented in the shape of a Auto Assembly Plant. The fifth playing piece 38 is represented in the shape of a Timber Mill. The sixth playing piece 40 is represented in the shape of a Chemical Processing Plant, and the seventh playing piece 42 represents the Armed Forces.

Players will use their playing piece as a token by which they will use to mark their progress through the fiscal year. Players will place their playing piece on the playing squares they land on. The playing pieces are represented in the general shape of each industry involved in Superfund.

Figure 3:
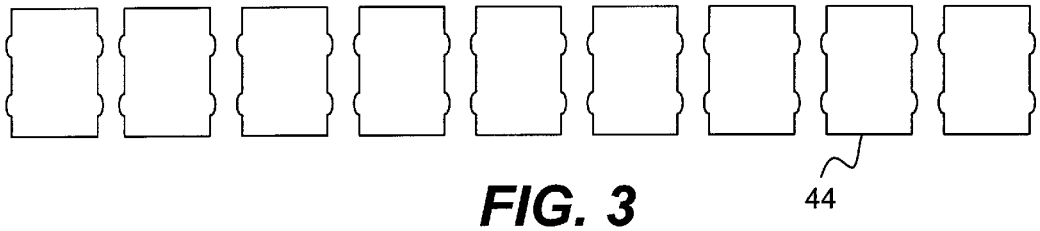
FIG. 3 illustrates the leaking hazardous barrels that players will place in the Superfund when landing on the hazardous waste disposal playing square.

FIG. 3 illustrates the Leaking Barrel pieces 44 used in the game. Leaking Barrels symbolize the industrial waste left over by generators and transporters. The Leaking Barrels 44 are placed in the Superfund 20 as players land on Pollution Squares marked on the playing board surface.

Figure 4:
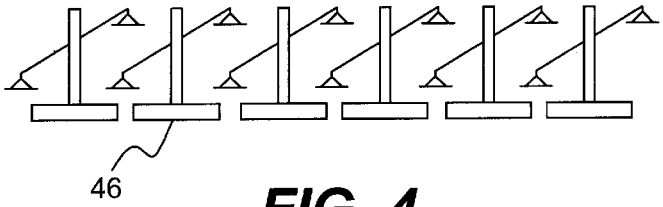
FIG. 4 illustrates the justice scales that players will use in order to mark the playing square they were on before placing their playing piece in the litigation pit or lit pit.

FIG. 4 shows the Justice Scale pieces 46, which are used to be placed on the square a player is on when the player is doing battle in the Litigation Pit (LIT PIT) 20.

Figure 5:
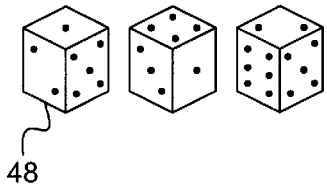
FIG. 5 illustrates the three (3) dice used in the board game, including: moving through the fiscal year of the board game; litigating battles; buying pollution prevention technology; enforcing fines/penalties and/or receiving profits.

Referring now to FIG. 5, playing dice 48 are used by players to move a playing piece about the game board. The dice 48 are also used to litigate with the EPA or other players, and also to execute various playing situations, (i.e.) determine profits, losses, stock points, modern technology, moving up spaces or moving back spaces.

Figure 6:
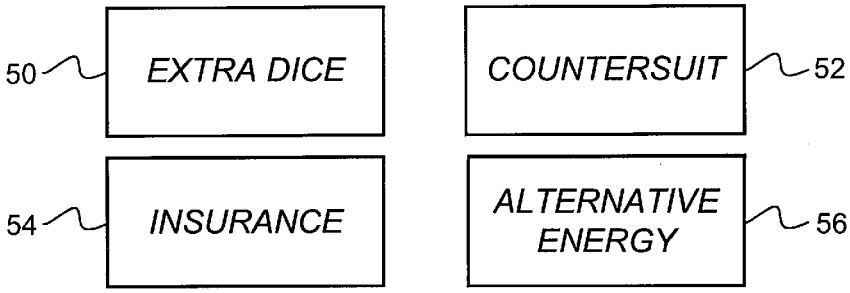
FIG. 6 illustrates the playing tokens that players may receive during play, including: extra dice, countersuit, insurance, and alternative energy.

FIG. 6 illustrate playing tokens 50, 52, 54, 56 that are used during the course of the game. The playing tokens are comprised of: Extra Dice, Countersuit, Insurance and Alternative Energy. These playing tokens give a player a variety of strategic options.

The Free Dice token 50 allows a player to roll an additional dice during: a movement roll, profit roll, payment roll or any litigation battle.

The Countersuit token 52 allows a player to "counter-sue" any party suing the player holding the Countersuit token.

The Insurance token 54 allows a player to move up one (1) playing square at any time the player chooses.

The Alternative Energy token 56 allows a player to move up two (2) playing squares at any time the player chooses.

Playing tokens are awarded mostly from playing cards. They may be cashed into the bank for $3 million at anytime during play (optional).

Referring now to FIGS. 7–10, which represent the playing cards 58, 60, 62, 64. Playing cards are drawn from their appropriate stack when a player lands on a playing card's specific color. There are twenty -five cards per each subject of playing cards, the subjects include: EPA 58, Lawyer 60, Corporate 62, and Community 64. Playing cards may enhance or detract from a player's round of play.

Referring now to FIG. 7, which represent the EPA (Environmental Protection Agency) cards 58. EPA cards are generally a liability to a player's playing situation. EPA cards are drawn by a player from their stack when a player lands on any blue playing square. As can be seen on the cards, various penalties and bonuses are described on each card.

Referring now to FIG. 8, which represent the Lawyer cards 60. Lawyer cards are generally a liability to a player's playing situation. Lawyer cards are drawn from their stack when a player lands their playing piece on any red playing square. As can be seen on the cards, various penalties and bonuses are described on each card.

Referring now to FIG. 9, which represent the Corporate cards 62. Corporate cards are playing cards that are usually beneficial to a player's playing situation. Corporate cards are picked up from their stack when a player lands their playing piece on any yellow square. As can be seen on the cards, various penalties and bonuses are described on each card.

Referring now to FIG. 10, which represent the Community cards 64. Community cards are playing cards that are usually beneficial to a player's playing situation. Community cards are picked up from their stack when a player lands their playing piece on any green playing square. As can be seen on the cards, various penalties and bonuses are described on each card.

Figure 11:
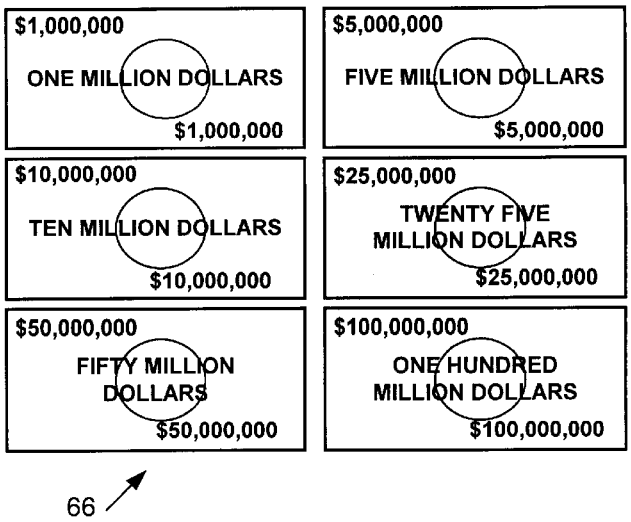
FIG. 11 illustrates the money that will be used as the board game's currency.

Referring now to FIG. 11, which represents the playing money 66. Playing money is in denominations of "millions" of dollars. The playing money is comprised of: $1 million, $5 million, $10 million and $25 million dollars. Playing money 66 is used as the essential possession to winning the game. The player with the most money at the end of the game wins. Money is used to collect profits at the end of each Fiscal Quarter, to collect profits as bonuses, to paying violations and fines and to purchase modern technology.

Figure 12:
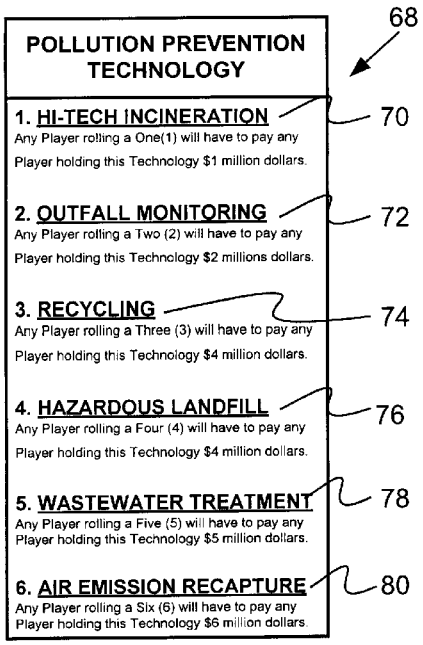
FIG. 12 illustrates the pollution prevention technologies that players will have the option to purchase, these technologies include: hi-tech incineration, outfall monitoring, recycling, hazardous landfill, wastewater treatment and air emission recapturing.

FIG. 12 illustrates the game's Pollution Prevention Charts 68. The Pollution Prevention Charts are comprised of: Hi-Tech Incineration 70, Outfall Monitoring 72, Recycling 74, Hazardous Landfill 76, Wastewater Treatment 78, and Air Emission Recapture 80.

1) Hi-Tech Incineration 70: any player rolling a one (1), must pay the Hi-Tech owner, $1 million dollars. Also, the player must deduct $2 million for any air violation.
2) Outfall Monitoring 72: any player rolling a two (2), must pay the Outfall Monitoring owner, $2 million dollars. Also, the player must deduct $1 million for any water violations.
3) Recycling 74: any player rolling a three (3), must pay the Recycling owner, $3 million dollars. Also, the player must deduct $1 million for any land violations.
4) Hazardous Landfill 76: any player rolling a four (4), must pay the Landfill owner, $4 million dollars. Also, the player must ignore any Leaking Barrel Disposal playing squares.
5) Wastewater Treatment 78: any player rolling a five (5), must pay the Wastewater Treatment owner, $5 million dollars.
6) Air Emission Recapture 80: any player rolling a six (6), must pay the Air Emission Recapture owner, $6 million dollars.

Figure 13:
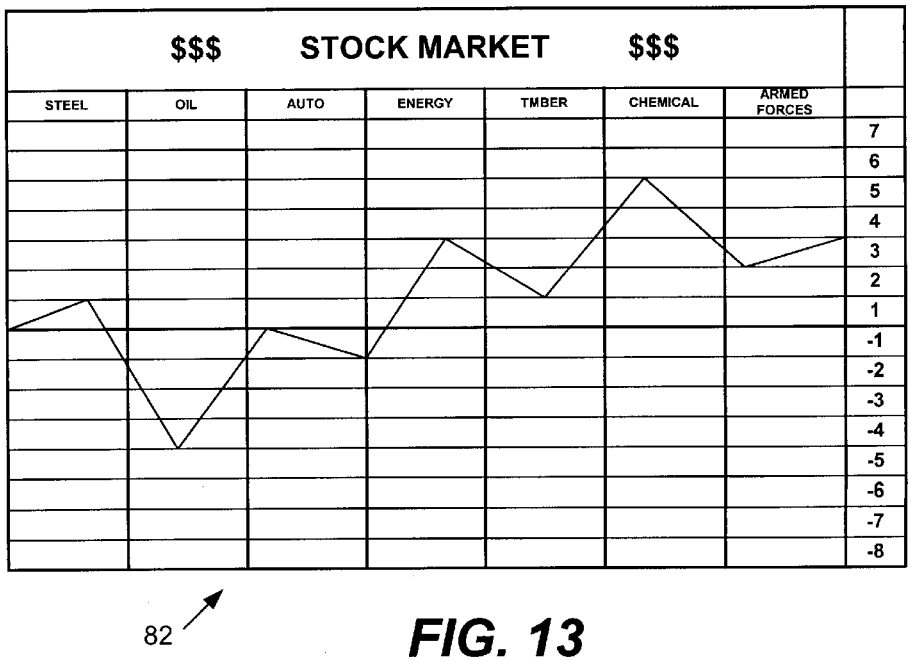
FIG. 13 illustrates the modem technology/wall street chart used to monitor and track a player's technologies and/or stock value throughout the fiscal year of the board game.

FIG. 13, embodies the Stock Market Chart 82 used in the board game. The Stock Market Chart 82 tracks the stock value of the companies being affected continuously throughout the game. A player's company stock value can be affected by the following:

* Each time a player places a Leaking Barrel into the LIT PIT, the player's stock value goes down one (1) point.
* Each time a player loses a Permit, the player's stock value goes down one (1) point.
* Each time a player obtains a Permit, the player's stock value goes up one (1) point.
* Each time a player wins a Lawsuit, the player's stock value goes up one (1) point.
* Each time a player loses a Lawsuit, the player's stock value goes down one (1) point.
* Each time a player rolls for Profits (including Fiscal Quarters), the player's stock value goes up one (1) point.
* Each time a player rolls for a payment to the bank, the player's stock value goes down one (1) point.
* Each time a player obtains a Pollution Prevention Technology, the player's stock value goes up two (2) points.

Figure 14:
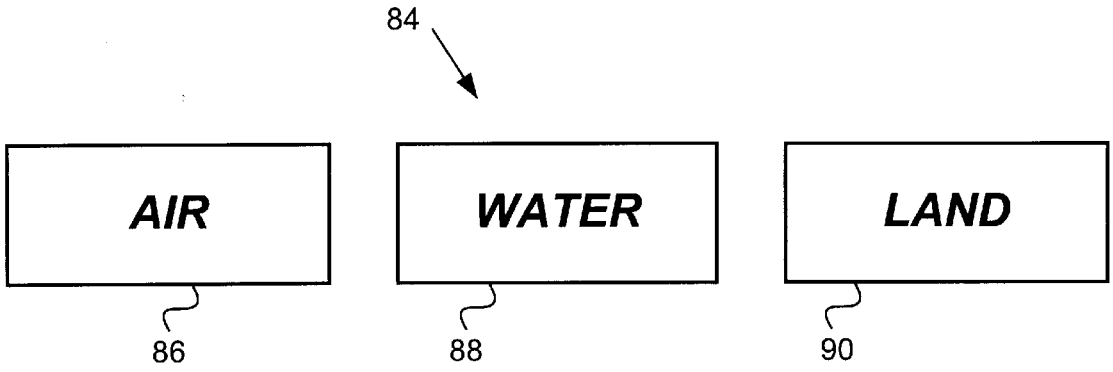
FIG. 14 illustrates the permits a player will need to obtain during the course of the game, these include: air, water, and land.

FIG. 14 illustrate the permits 84 that are used in the game. The permits include: Air 86, Water 88 and Land 90, which are necessary to proceed with play beyond the first fiscal quarter.

Figure 15:
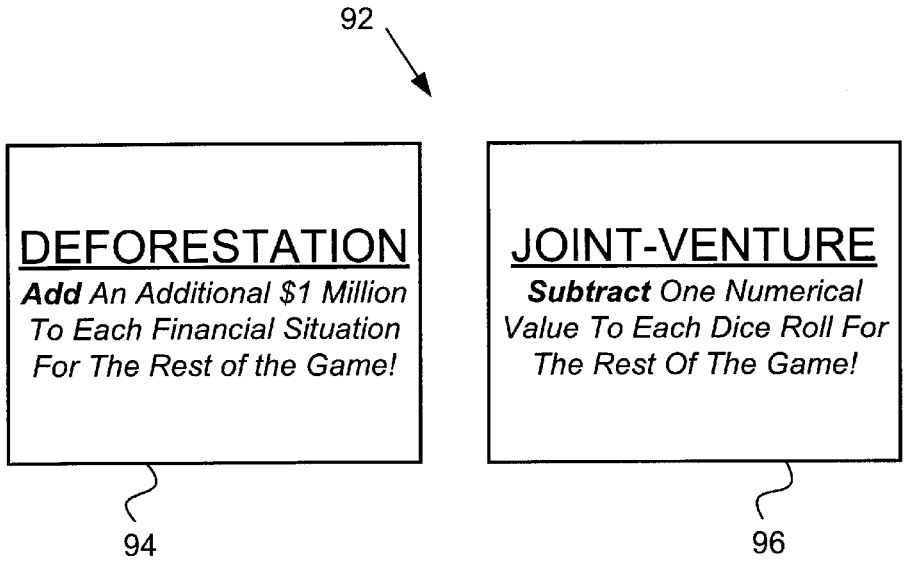
FIG. 15 illustrates playing markers that players might obtain during the course of the game, these include: deforestation and join-venture.

Referring now to FIG. 15, there are illustrated two Playing Markers 92 drawn by a player when landing on either the "Deforestation Playing Square" or "EPA Joint Venture Playing Square."

The Deforestation Marker 94 places a player in the situation to add an additional $1 million to each financial playing situation for the rest of the player's fiscal year.

The EPA Joint Venture Marker 96 places a player in the situation to subtract one numerical value to all dice rolls for the rest of the player's fiscal year.

Figure 16A:
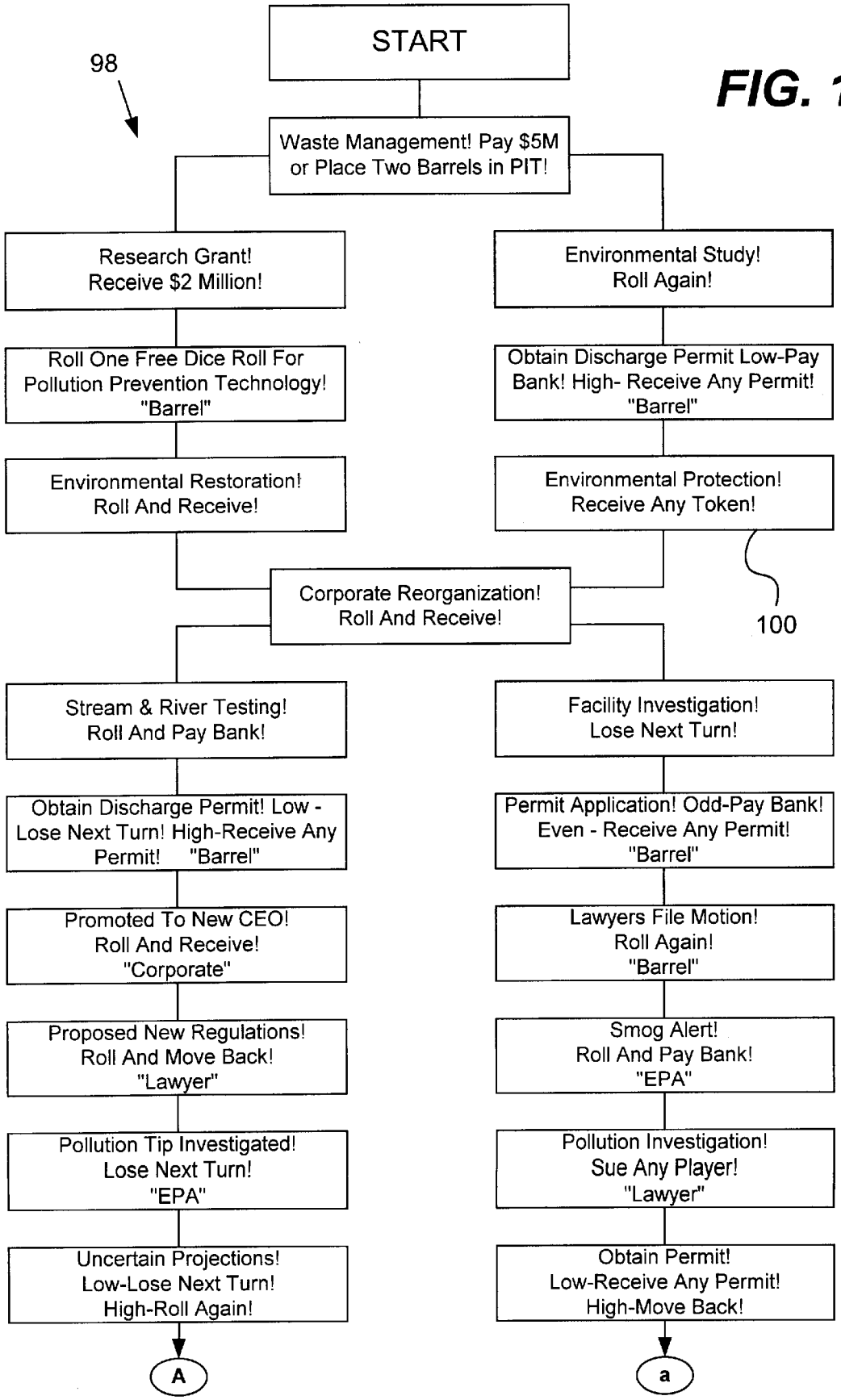
FIG. 16*a* illustrates an example playing path for a player to follow during the course of the board game.
Figure 16C:
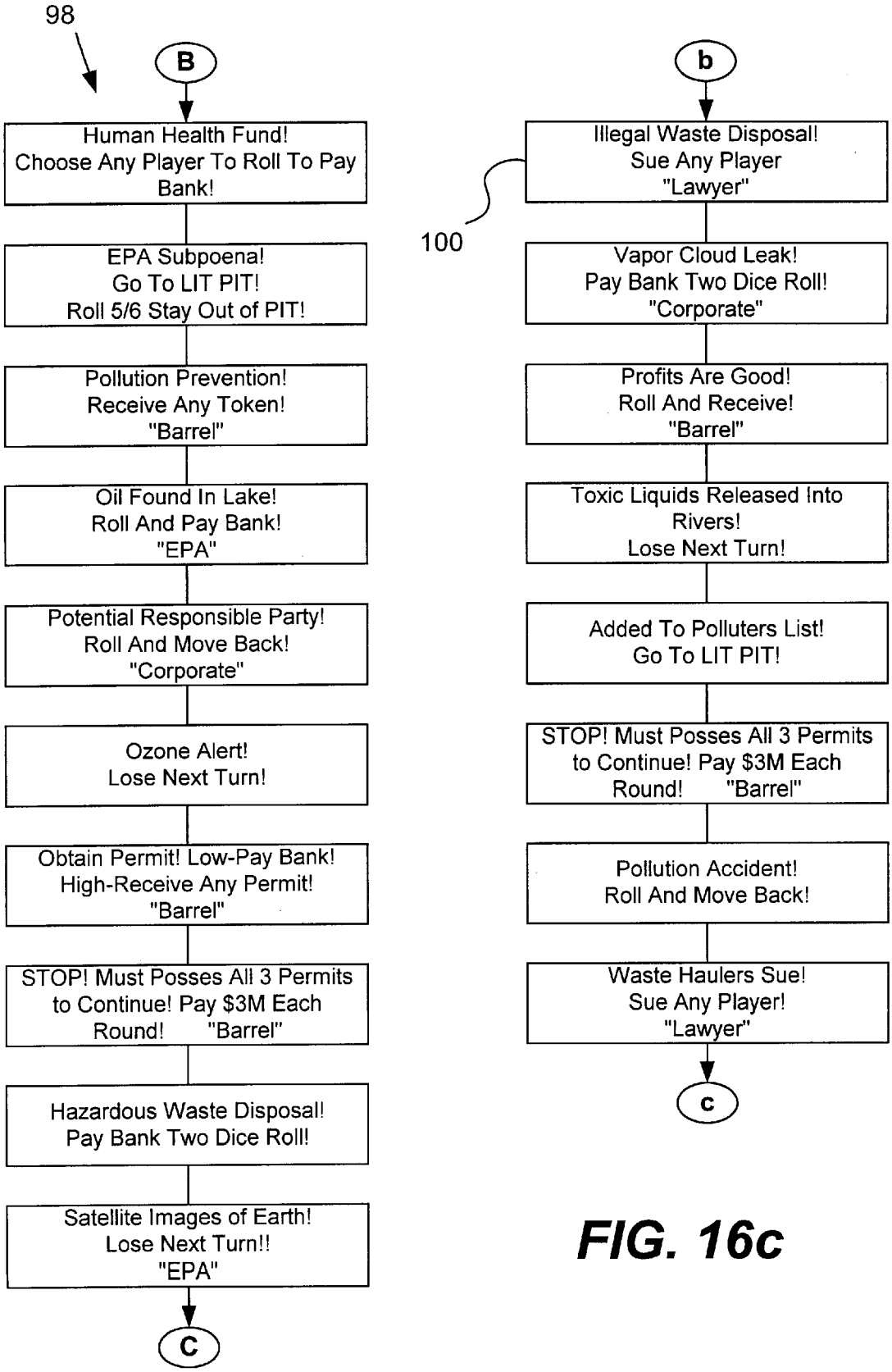
FIG. 16*c* illustrates the board game's playing path continued from FIG. 16*b;*
Figure 16D:
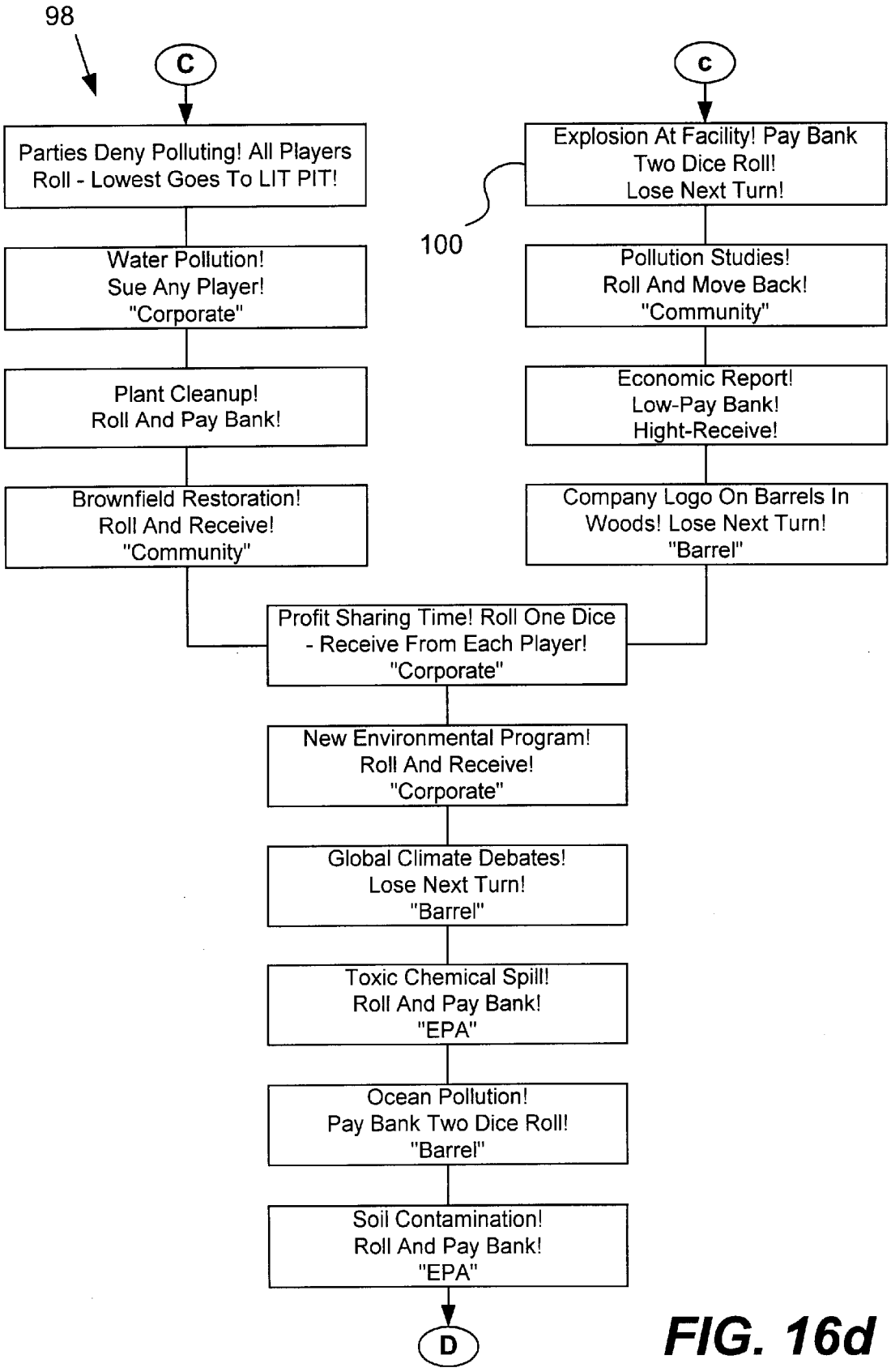
FIG. 16*d* illustrates the board game's playing path continued from FIG. 16*c;*
Figure 16E:
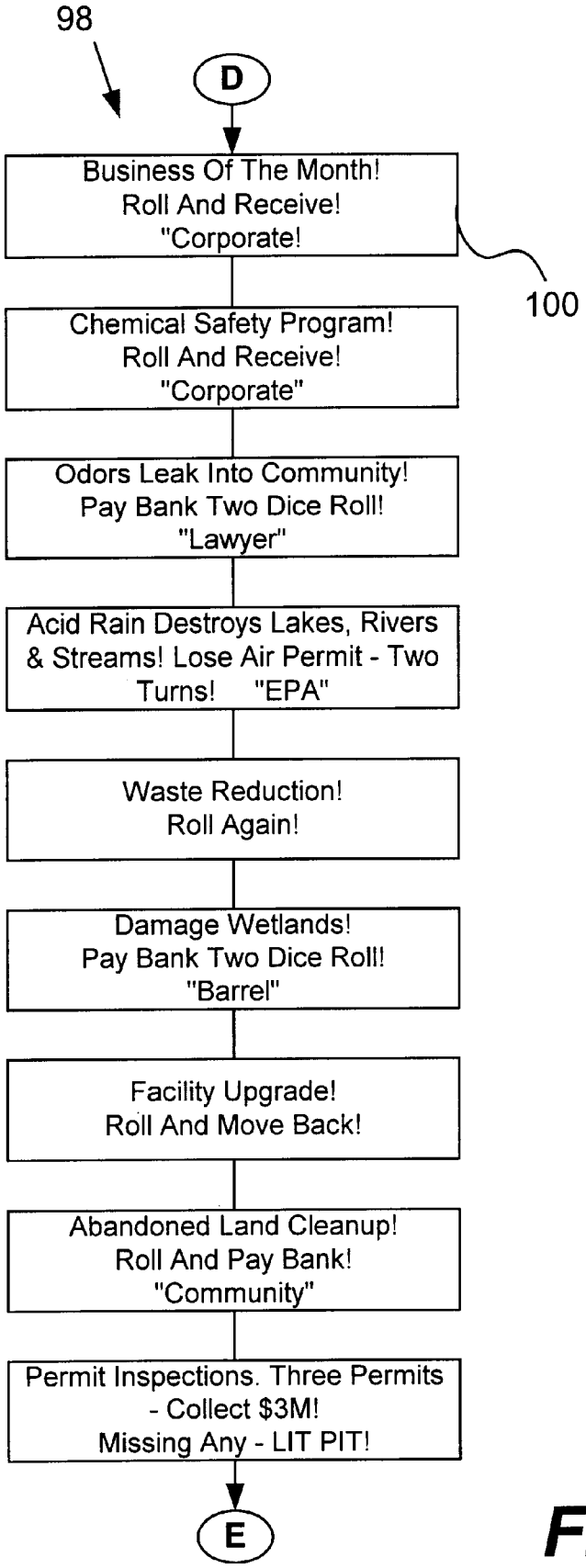
FIG. 16*e* illustrates the board game's playing path continued from FIG. 16*d;*
Figure 16F:
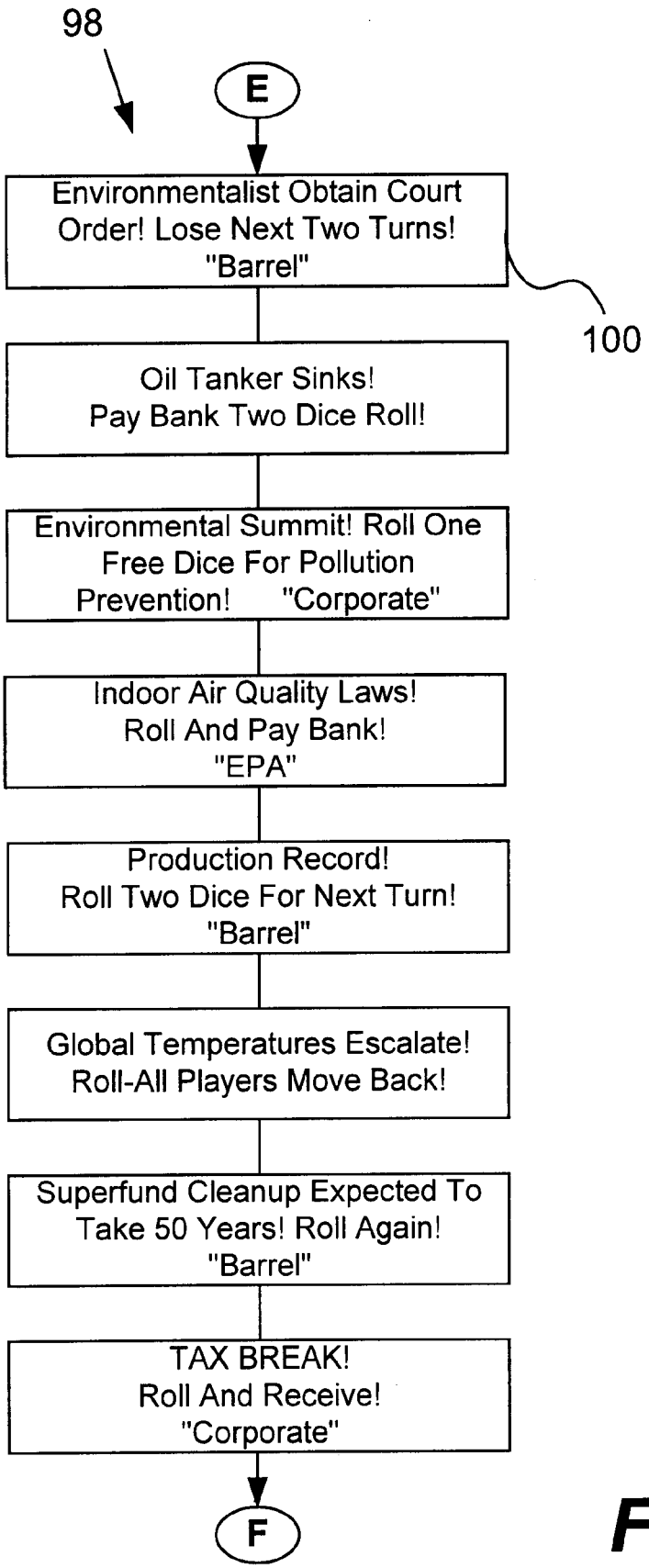
FIG. 16*f* illustrates the board game's playing path continued from FIG. 16*e;*
Figure 16G:
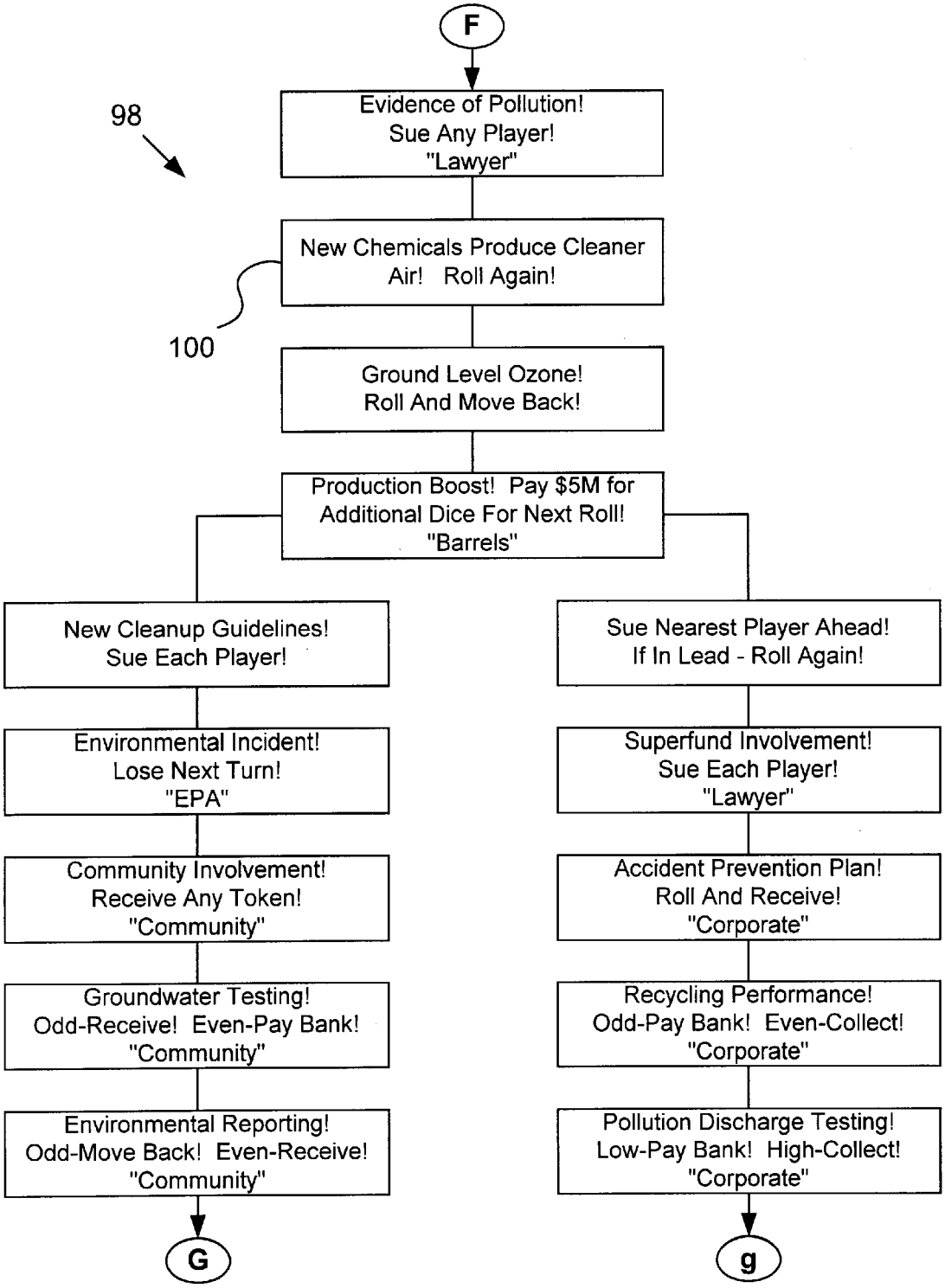
FIG. 16*g* illustrates the board game's playing path continued from FIG. 16*f;*
Figure 16H:
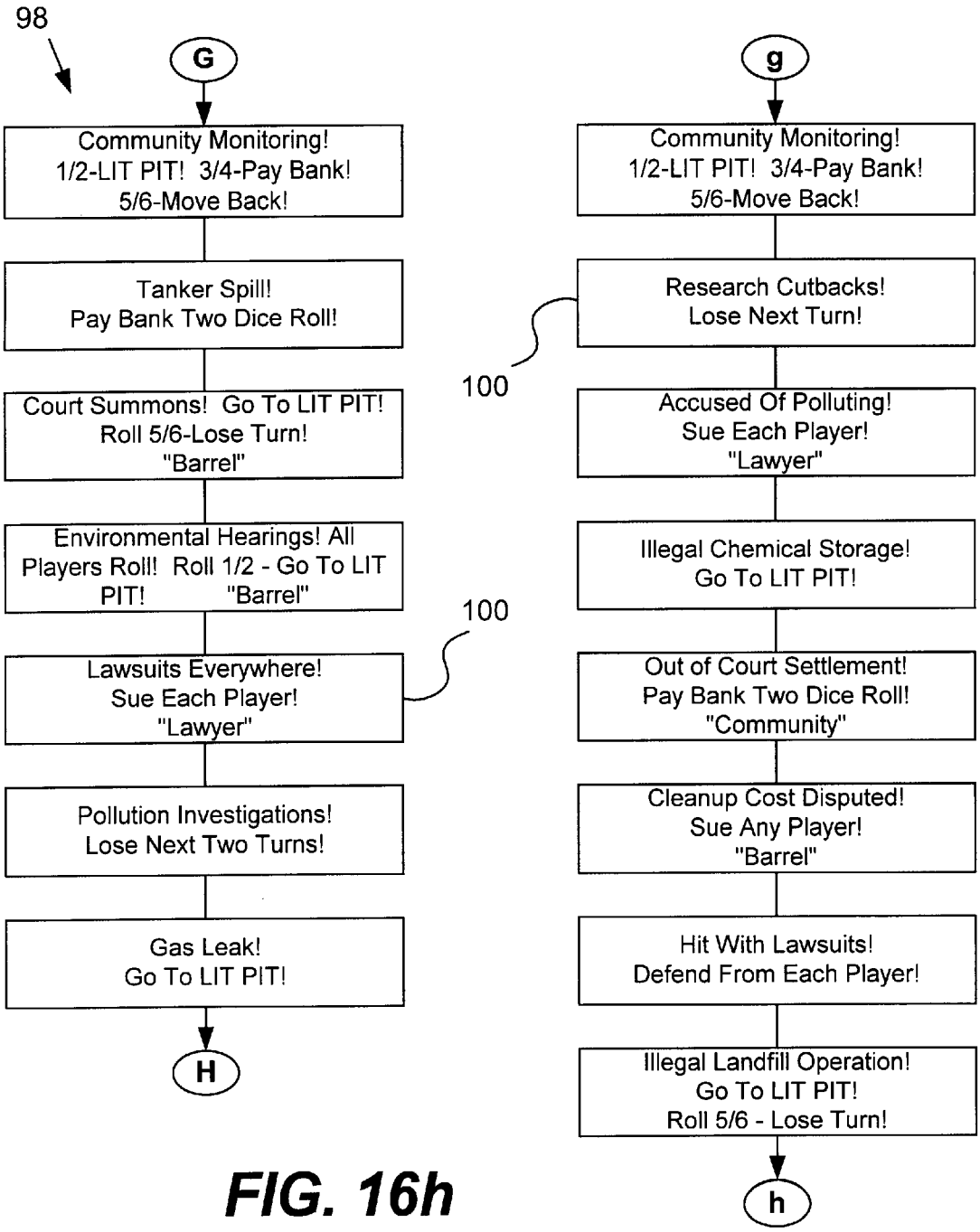
FIG. 16*h* illustrates the board game's playing path continued from FIG. 16*g;*
Figure 16I:
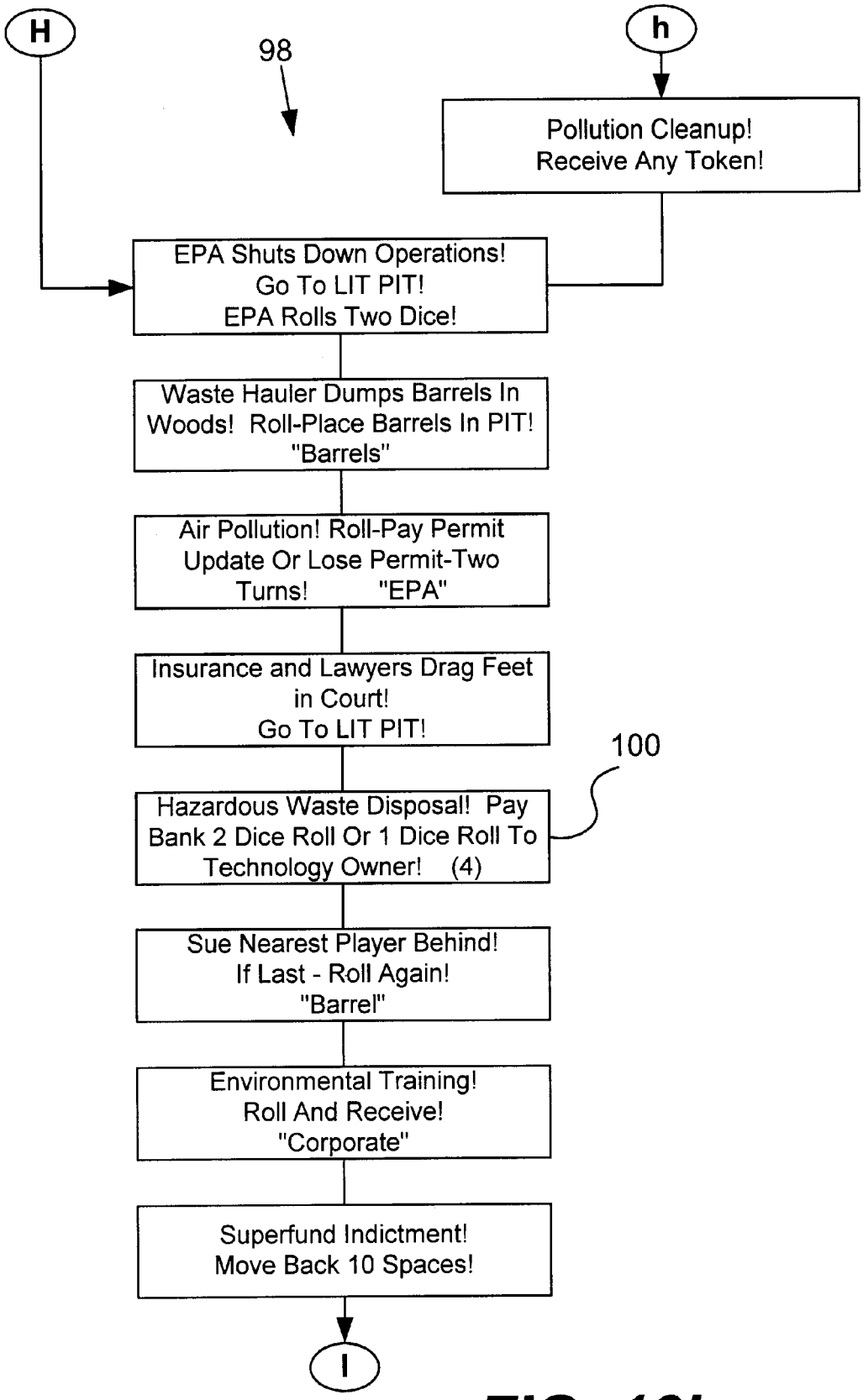
FIG. 16*i* illustrates the board game's playing path continued from FIG. 16*h;*
Figure 16J:
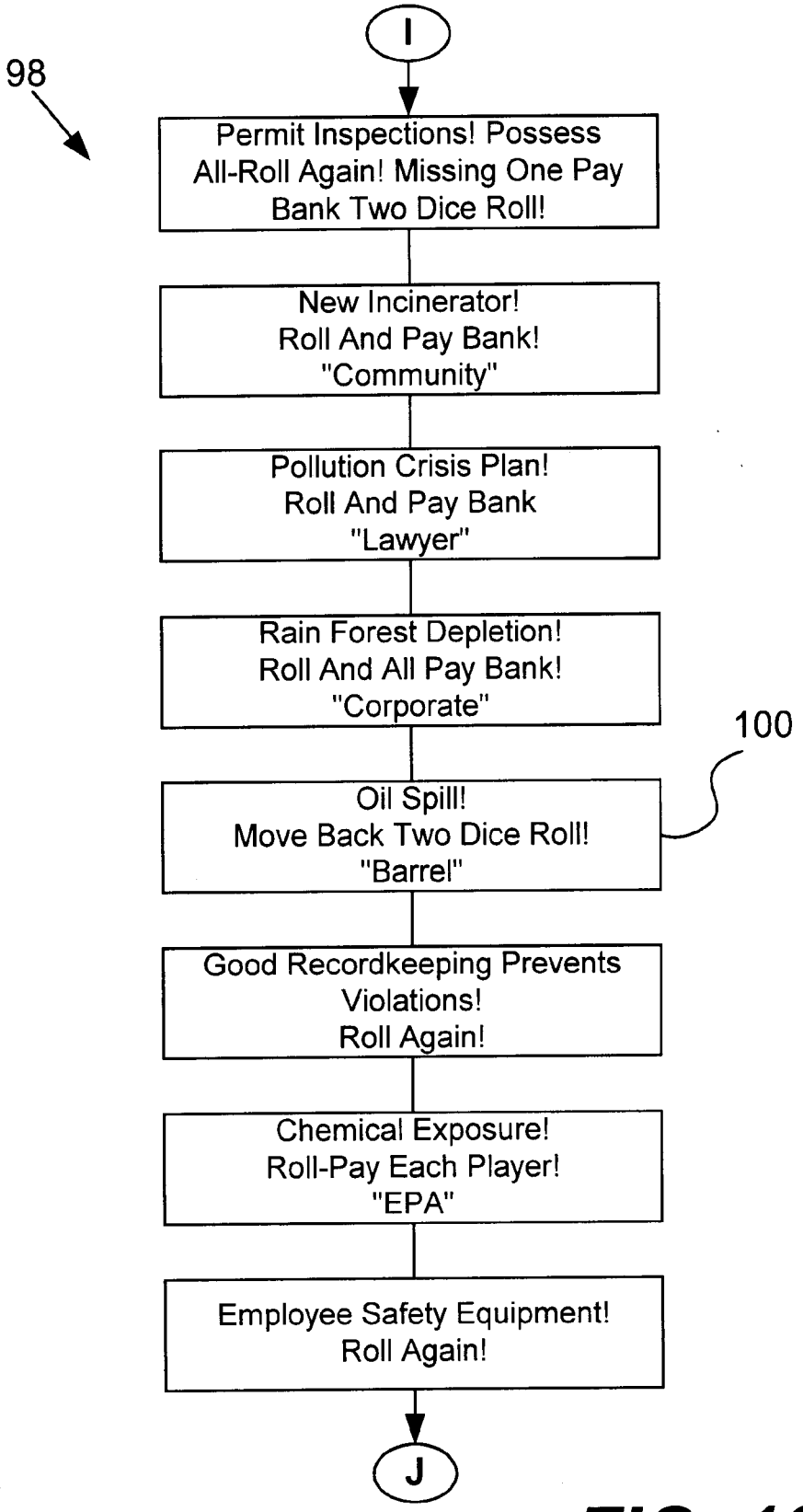
FIG. 16*j* illustrates the board game's playing path continued from FIG. 16*;*
Figure 16K:
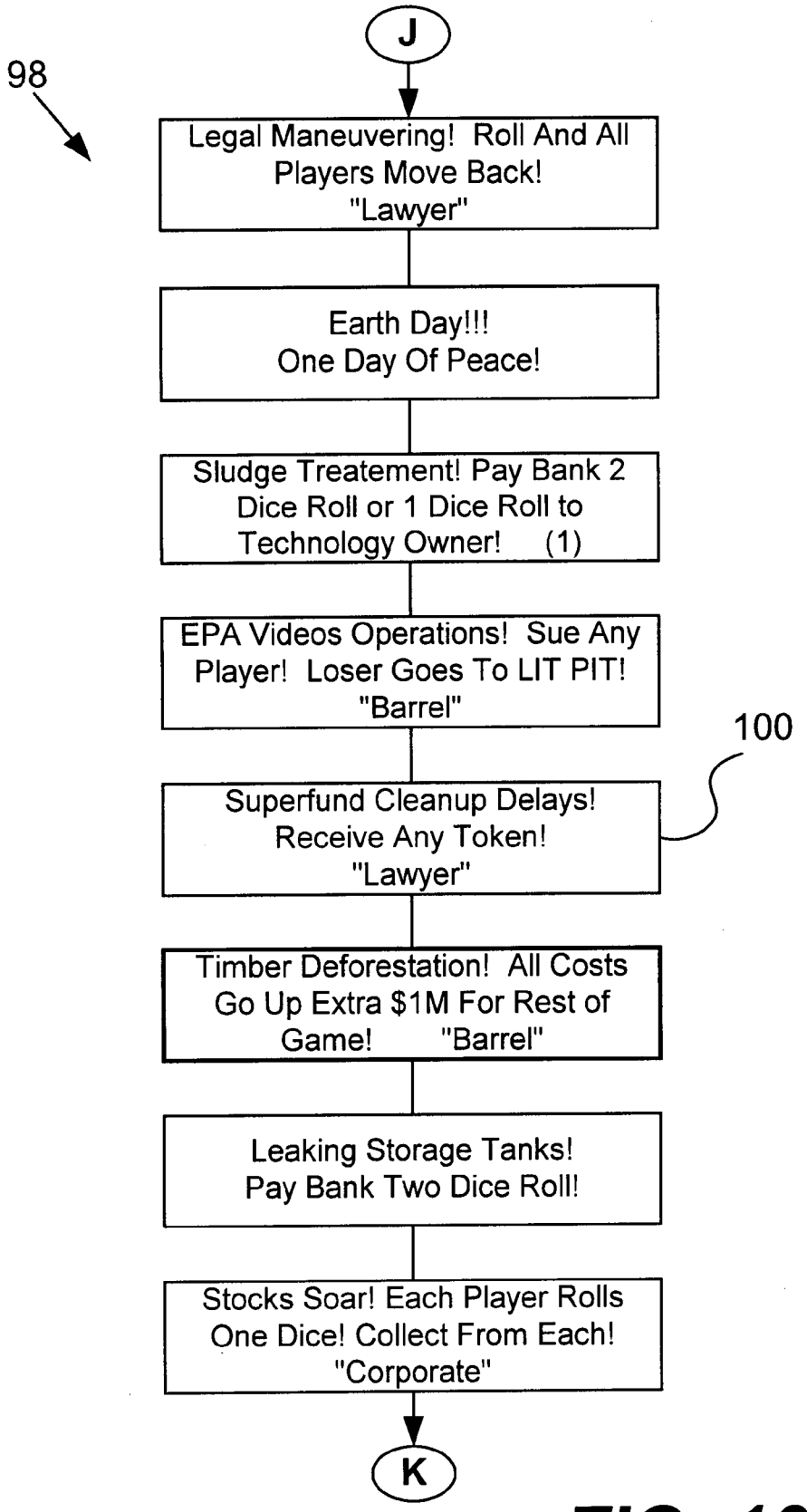
FIG. 16*k* illustrates the board game's playing path continued from FIG. 16*j;*
Figure 16I:
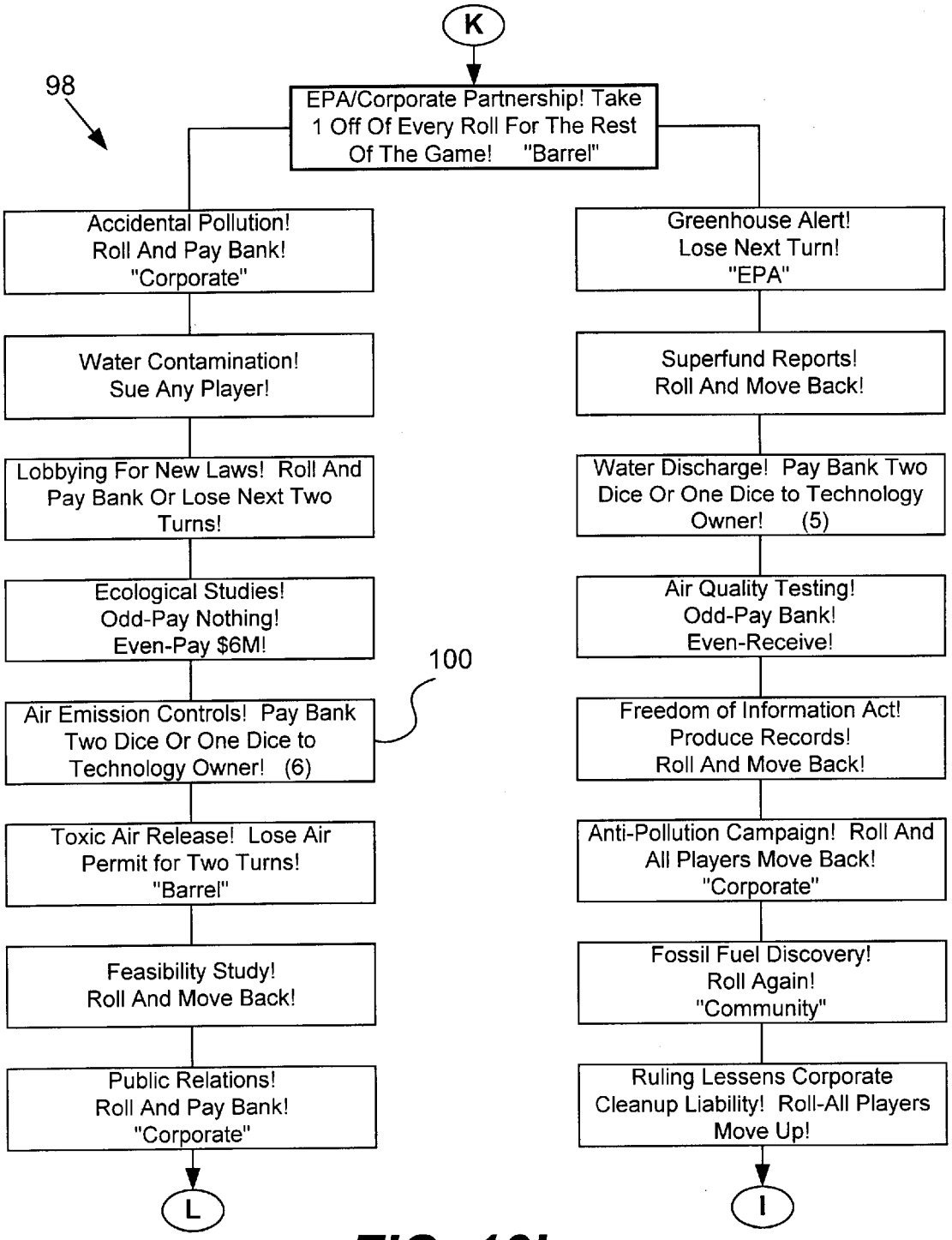
Figure 16M:
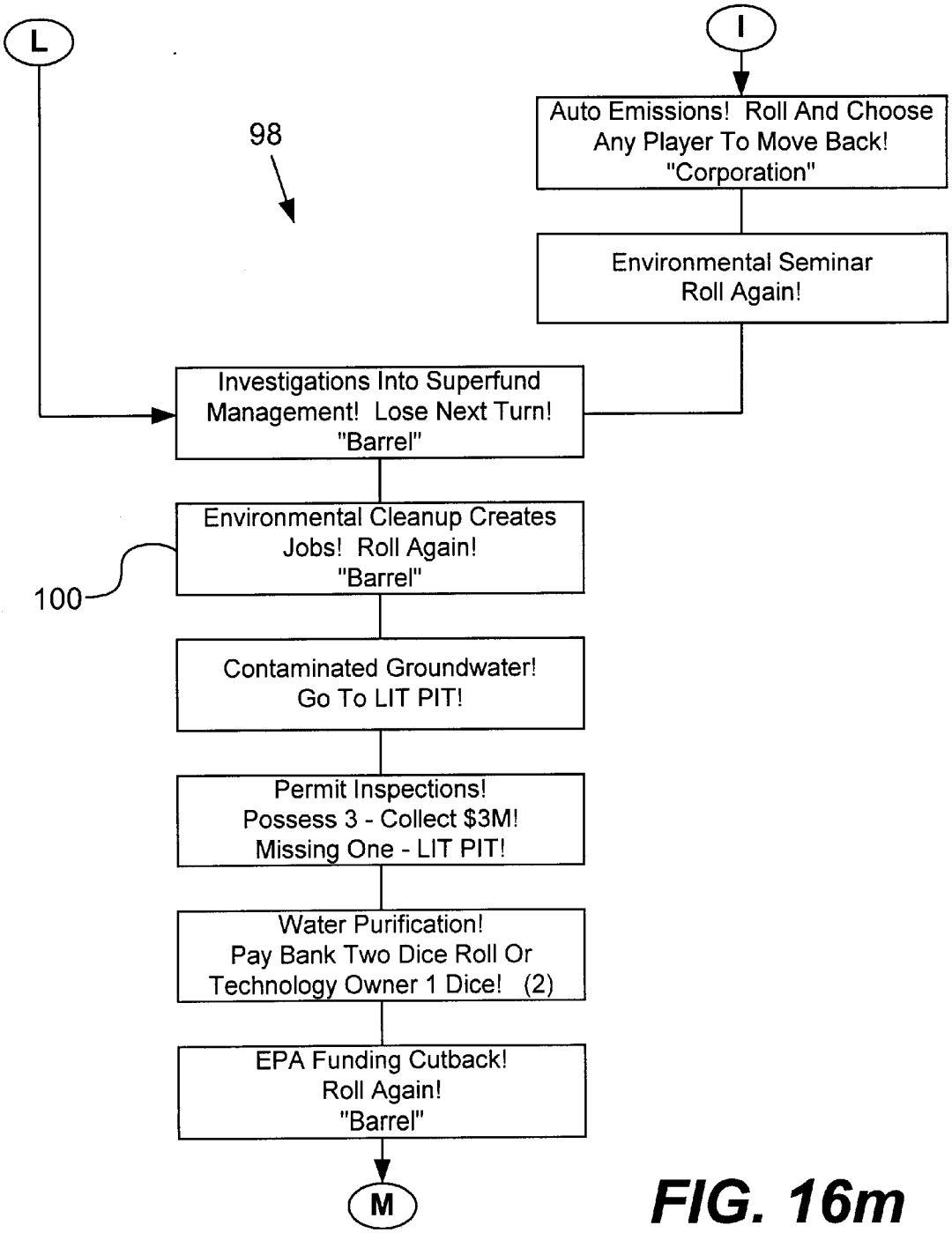
FIG. 16*m* illustrates the board game's playing path continued from FIG. 16*l;*
Figure 16N:
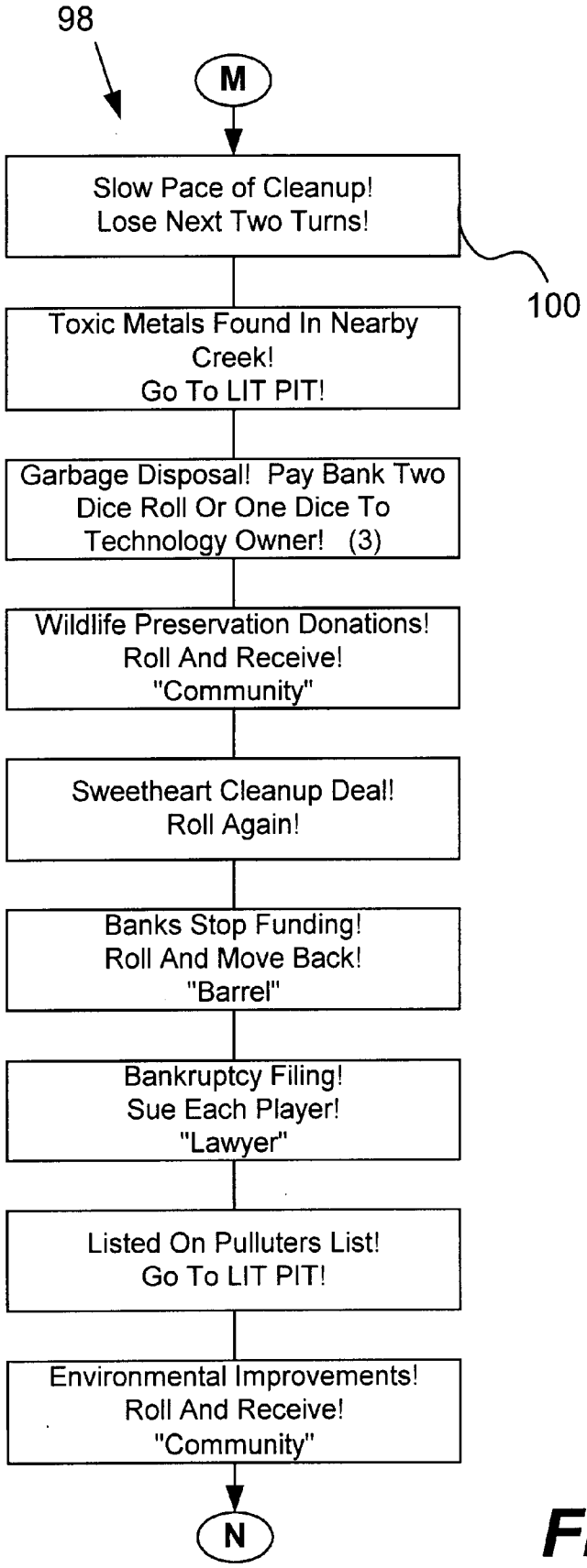
FIG. 16*n* illustrates the board game's playing path continued from FIG. 16*m*.
Figure 16O:
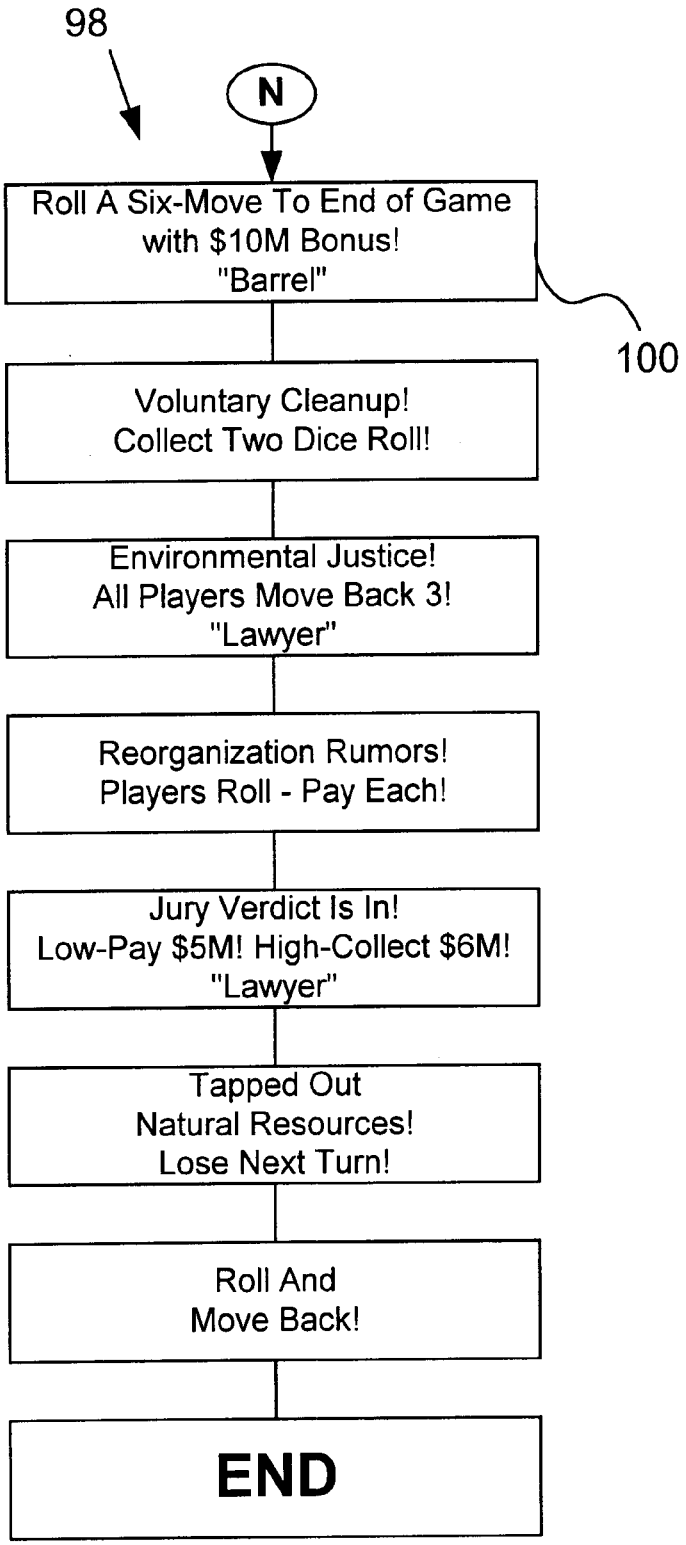
FIG. 16*o* illustrates the end of the board game's playing path continued from FIG. 16*n.*

FIGS. 16*a*–16*o* illustrate a playing route 98 with a plurality of playing squares 100 that are used in playing the board game of the present invention. The playing squares 100 contain instructions and information for players to follow throughout the course of the game. The instructions and information contained in the playing squares 100 follow the theme of the board game, namely concerns that a company may encounter throughout four fiscal quarters in how it can relate to the Superfund and to the environment.

Rules and Method of Play

The board game consist of a rectangular ply of cardboard with a colorful scenic display of the environment on the playing surface. Throughout the scenic environmental playing surface is a murky Superfund Site (Litigation Pit) centered nearly in the middle of the board.

Around the entire Superfund Site is a playing route that weaves in and out and through the entire playing surface which displays the various scenes of the playing surface, i.e. (Rain Forest, Oceans, Lakes/Rivers and Habitat). The playing route splits into two separate playing routes which always merges into a single playing route.

RULES:

The rules of my Superfund board game are quite simple. A player must guide their company through various environmental requirements in the best interests of the company, with considerations to the government, community and any other legal requirements.

In order to do so, a company must possess three permits beyond the first fiscal quarter, maintain fiscal responsibility for any fines, penalties, scientific studies, plant upgrades, lawsuits and any other demand placed upon it by government, the community and any other legal obligation throughout the fiscal year.

The number of players are limited to 2–7 players generally ranging in age of 10 years old and up. Among the various playing pieces used for playing Superfund include: playing pieces, dice, playing cards, barrels, permits, money, justice scales, tokens, markers and pollution prevention/stock market chart.

METHOD OF PLAY:

In playing this game, each Player places their company's playing piece on the game board apparatus. Players in turn roll dice and move their playing piece the amount of spaces showing on the dice. After moving to the space, the player will follow the playing situation dictated on the playing square. In conjunction, the player may also draw a playing card, depending on the color of the square they land on (Corporate/yellow), (Community/green), (EPA/blue), (Lawyer/pink) which adds another dimension of play to the player's turn.

Players will continuously face and decide which actions will be best for their company. Many of the playing squares deal with environmental and corporate compliance issues. Strategies for players will depend on choosing which route or playing decision to take the company through. The result will depend on the player's ability to roll dice as mostly needed in each given situation.

A player on a typical turn will first, have an opportunity to announce an intention to purchase a chance(s) for Pollution Prevention Technology. If an attempt is being made to roll for chances to obtain Pollution Prevention Technology, then the player chancing will roll their dice at this point. If the player rolls any sixes (6's), then they have scored a "Technical Breakthrough" and will roll all dice rolled as a six (6) to determine which Pollution Prevention Technology will be obtained.

If no dice purchase was made or if the player declined to chance a Pollution Prevention attempt, then the player proceeds to roll one (1) dice to move their playing piece along the playing route. The roll will determine how many spaces to move their playing piece. The player will then play out the situation presented by that playing square. If landing on a "colored" playing square, the player will then play out the situation dictated on the corresponding playing card. Once all options have been played out, the player will then hand over the dice to a player whose turn is next.

When a player lands on an orange playing square, the player must automatically place a Hazardous Barrel into the Superfund. All Hazardous Barrels remain in the Superfund (LIT PIT) until every player has ended the fiscal year. Once every player has finished the fiscal year, every player will roll one (1) dice for each round of legal battle to cleanup the Superfund site. The player rolling the highest will be able to remove one (1) Hazardous Barrel per victory from the Superfund. Other Hazardous Barrels must remain in the Superfund until the next round of rolls. This play continues until only one player's Hazardous Barrels remain, wherein that player will have to pay $5 million dollars for the cleanup cost per each Hazardous Barrel left in the Superfund.

STARTING THE GAME:

The game starts when the sequence of player turns has been determined. This occurs after every player rolls a dice and having the highest roll go first and the lowest roll going last. Any ties must be resolved by rolling again until a winner is determined. If all players agree, a clockwise rotation may also be used to determine the sequence of player's turn.

Each player will choose a playing piece as well as receiving $100 million dollars to start the game with.

Each player will place each of their permits (Air, Water, Land) in the Superfund site. They will only possess them after they have earned them through the play of the game.

Each player will also be in possession of all the Hazardous Leaking Barrels corresponding in color with their playing piece.

The Hazardous Leaking Barrels are placed in the Superfund site when a player lands on an orange playing square or when a player is in debt and needs to borrow from the bank. When a player is in debt, the player may borrow from the bank $3 million dollars for each Hazardous Leaking Barrel placed in the Superfund site. However, at the end of the game, the cost of clean up for each Barrel will be $5 million.

A player may only place the amount of Hazardous Leaking Barrels in the Superfund site only when in the situation where the player has not enough money to play out a playing situation. In that event, the player can only borrow/place the amount of Barrels needed to play off the debt.

The Superfund game begins after a player's sequence of turns has been determined and all players have collected their playing piece, money, permits and their Hazardous Leaking Barrels. The next step is for Superfund to begin.

A Player's turn consists of:

1) Announcing any intentions to purchase Pollution Prevention Technology. If so, the player pays the bank, $10 million dollars for each dice (3 maximum) to attempt a roll of a six (6). For each six (6) rolled, a Pollution Prevention Technology breakthrough has occurred. The player will then roll those dice rolled as a six (6) to determine which Pollution Prevention Technology they have gained. The player then places a Marker on that Technology to indicate that they posses the Pollution Prevention Technology. The player will then roll one (1) dice to move their playing piece on the playing route.

If a player chooses not to purchase an attempt for Pollution Prevention Technology, they will proceed with their turn and roll one (1) dice to determine how many spaces they will be allowed to move their playing piece along the playing route.

Once landing on a playing square, the player must play out the playing scenario indicated on each square. If a player lands on a playing square that is colored, the player must draw a playing card from the deck of playing cards matching in color with the playing square, with the exception of orange, which indicates that a player must place one Hazardous Leaking Barrel into the Superfund site.

PLAYING SQUARES:

The options of colored playing squares are as follows:

green playing squares indicate community cards;

yellow playing squares indicate corporate cards;

blue playing squares indicate EPA cards; and pink playing squares indicate lawyer cards.

A player may also confront a playing route that splits into two separate playing routes. In this case, the player has the option of choosing which playing route is best for their company. Usually the shorter routes tend to have potentially bigger pay-off's or bigger liabilities and the longer routes tend to consist of more conservative options.

Scenarios prescribed on the playing squares vary in degree. Playing squares consist of players possibly playing out a variety of options which include:

moving forward/moving backwards;

rolling the dice again/losing a turn;

rolling for profits/rolling to pay a violation;

suing another player/being sued by a player;

obtaining a permit/losing a permit;

being taken to court/battling to stay out of court;

preventing pollution/creating pollution;

environmental compliance/non-compliance.

There are also a host of other corporate, community, governmental or legal issues prescribed in the actual Superfund program.

LAWSUITS:

Lawsuits can occur between two or three or all players or between a player and the EPA.

Lawsuit Between Players:

When a player is suing another player or players, the player doing the suing (plaintiff) always rolls first. The player/players being sued (defendant) must then roll second. The player rolling the highest wins the lawsuit. The loser of the lawsuit must then pay the winner what the winner rolled on their dice. All monetary denominations are in "millions of dollars."

If a player is suing more than one player, each legal battle is done one at a time.

If a player is being sued by the EPA, the player will place their playing piece in the Superfund site, which will now be referred to as the Litigation Pit or "LIT-PIT," and place their marker on the playing square they have vacated. Once in the LIT PIT, a player must roll higher than the EPA in order to free themselves from the legal grips of the EPA. This is done in the same fashion as the rest of the lawsuits, except in this case a few exceptions occur, such as:

The player in the LIT PIT will chose what other player will roll on behalf of the EPA.

The EPA (player rolling on behalf of the EPA) will always roll first.

If the player being sued loses, they will have to pay the bank, what they have rolled as a losing effort. Additionally, they must remain in the LIT PIT until their next turn, when they will have another chance to beat the EPA.

If the player beats the EPA, they will place their playing piece back on the playing square that they vacated prior to landing in the LIT PIT. They will be allowed to resume play on their next turn.

THE SUPERFUND SITE/LITIGATION PIT (LIT PIT):

The Superfund site serves two purposes. The first is when players land on any orange playing squares, they will have to automatically place one (1) Hazardous Leaking Barrel into the Superfund site. These Barrels will remain in the Superfund site until the end of the game, when all players will engage in a legal battle to remove their own Hazardous Leaking Barrels from the Superfund site. The player that has Barrels still remaining in the Superfund site will have to pay $5 million dollars a Barrel, for clean up.

The second purpose for the Superfund site is when it becomes the litigation pit or the "LIT PIT." In this setup, players being sued by the EPA will have to vacate their playing piece from the playing square they were on and place their playing piece in the Superfund site now known as the litigation pit or "LIT PIT." All EPA vs. player(s) legal battles take place here. A players playing piece will remain in the LIT PIT until the player(s) are able to successfully defeat the EPA (a chosen player by the defendant) in a legal battle which occurs only once per the players turn.

FISCAL QUARTERS:

Players will have the opportunity to replenish their bank accounts by rolling two (2) dice when the players land on or roll past any of the three (3) Fiscal Quarters throughout the game. Players will roll the two (2) dice and be paid by the bank in tens of millions. Players are only allowed to roll for their profits once for each Fiscal Quarter.

PERMITS:

Permits are essential to a player's ability to have a license to operate a business. Permits in essence permit industrious emissions into the environment. However, permits include environmental standards in which companies must comply with. If a company is found to be in violation of the environmental standards, then the company can be fined by the EPA monetarily or through legal maneuvers ranging from lawsuits or revocation of a permit.

Before a player can go anywhere beyond the First Fiscal Quarter, the company must have in its possession all three (3) permits: Air, Water, and Land. During the course of play, players will possibly find themselves in situations where a permit is asked to be given up in replacement of fines. In other situations a player will be demanded to give up a permit without any option. When a permit is given up, a player must place that permit in the Superfund site for the specified amount of time.

Permits are obtained through playing squares and through playing cards. A player carries the permits throughout the entire Fiscal Year. Permits cannot be sold or traded for in any other fashion.

END OF THE GAME:

The game concludes when each player finds themselves at the end of the playing route (Fiscal year). Players that may have finished ahead of the last player to finish must wait patiently until all players have finished their Fiscal year. At this moment, all players will roll a dice to begin the cleanup of the polluted Superfund site. Players will roll one (1) dice each, all at the same time. The player with the highest roll, will be able to remove one (1) Hazardous Barrel from the Superfund site and place it in their playing tray. If more than one (1) player rolls the highest number, a roll off begins between those players until the tie is broken and a winner has been established. The winner of the roll off will be allowed to remove one (1) Hazardous Barrel from the Superfund site.

This continues until only one (1) Player's Hazardous Barrels are left in the Superfund site. At, this point the player with the Hazardous Barrels still left in the Superfund site, will have to pay the bank, $5 million dollars for each barrel still left in the Superfand site.

All players will then count up all their money and cash in any tokens to determine their company's "net worth." The player with the most money at the end of all this, will be the winner of Superfund.

As various possible embodiments may be made in the above invention for use for different purposes and as various changes might be made in the embodiments and method above set forth, it is understood that all of the above matters here set forth or shown in the accompanying drawings and flow charts are to be interpreted as illustrative and not in a limiting sense.

I claim:

1. A board game apparatus simulating environmental cleanup issues facing corporations, government, communities, and the environment comprising:

a) a board, said board acting as a playing field;

b) a plurality of marked spaces constituting a path extending across the board on the playing field, one of said marked spaces being a starting point and another one of said marked spaces being an ending point, wherein said path represents a fiscal year of corporate finance and environment compliance for a corporation;

c) a plurality of playing pieces, said playing pieces being used to mark progress of a game played on said board game;

d) a supply of playing money;

e) a chance device for determining the number of marked spaces over which a playing piece is moved, said chance device also used to perform playing situations;

f) a plurality of leaking barrel game pieces representing industrial waste, said leaking barrel game pieces being colored and corresponding to a particular player;

g) a plurality of justice scale game pieces, said justice scale game pieces being placed on a marked space occupied by a playing piece of a player when said player conducts a battle in a litigation pit;

h) a plurality of playing tokens, said tokens providing a player with a variety of strategic options that can be used while playing on said board game, said tokens being secured as determined by chance;

i) a plurality of playing cards, said playing cards being drawn by a player as determined by chance;

j) a plurality of permit cards, said permit cards including air permit cards, water permit cards, and land permit cards, wherein each player is required to secure an air permit card, a water permit card, and a land permit card before proceeding beyond a certain point along said path, said permit cards being secured as determined by chance;

k) a pollution prevention chart, said pollution prevention chart allowing a player to obtain a pollution prevention technology and enhance the play on the board game; and l) a stock market chart, said stock market chart being used to track a stock value of companies during play on the board game.

2. The board game apparatus of claim 1, wherein said path splits into two separate playing routes that merge back into a single playing route.

3. The board game apparatus of claim 1, wherein said playing pieces are shaped to represent a particular industry selected from the group consisting of: steel, oil, energy, chemical, auto, timber, and armed forces.

4. The board game apparatus of claim 1, wherein said playing tokens are comprised of: free dice tokens, countersuit tokens, insurance tokens, and alternative energy tokens.

5. The board game apparatus of claim 1, wherein said playing cards are comprised of: community cards, corporate cards, EPA cards, and lawyer cards.

6. A board game apparatus simulating environmental cleanup issues facing corporations, government, communities, and the environment comprising:

a) a board, said board acting as a playing field;

b) a plurality of marked spaces constituting a path extending across the board on the playing field, one of said marked spaces being a starting point and another one of said marked spaces being an ending point, wherein said path represents a fiscal year of corporate finance and environment compliance for a corporation;

c) a plurality of playing pieces, said playing pieces being used to mark progress of a game played on said board game;

d) a supply of playing money;

e) a chance device for determining the number of marked spaces over which a playing piece is moved, said chance device also used to perform playing situations;

f) a plurality of leaking barrel game pieces representing industrial waste, said leaking barrel game pieces being colored and corresponding to a particular player; and g) a plurality of playing cards, said playing cards being drawn by a player as determined by chance.

7. The board game apparatus of claim 6, wherein said path splits into two separate playing routes that merge back into a single playing route.

8. The board game apparatus of claim 6, wherein said playing pieces are shaped to represent a particular industry selected from the group consisting of: steel, oil, energy, chemical, auto, timber, and armed forces.

9. The board game apparatus of claim 6, wherein said playing cards are comprised of: community cards, corporate cards, EPA cards, and lawyer cards.

10. The board game apparatus of claim 6 further including a plurality of justice scale game pieces, said justice scale game pieces being placed on a marked space occupied by a playing piece of a player when said player conducts a battle in a litigation pit.

11. The board game apparatus of claim 6 further including a plurality of playing tokens, said tokens providing a player with a variety of options that can be used while playing on said board game, said tokens being secured as determined by chance.

12. The board game apparatus of claim 11, wherein said playing tokens are comprised of: free dice tokens, countersuit tokens, insurance tokens, and alternative energy tokens.

13. The board game apparatus of claim 6 further including a plurality of permit cards, said permit cards including air permit cards, water permit cards, and land permit cards, wherein each player is required to secure an air permit card, a water permit card, and a land permit card before proceeding beyond a certain point along said path, said permit cards being secured as determined by chance.

14. The board game apparatus of claim 6 further including a pollution prevention chart, said pollution prevention chart allowing a player to obtain a pollution prevention technology and enhance the play on the board game.

15. The board game apparatus of claim 6 further including a stock market chart, said stock market chart being used to track a stock value of companies during play on the board game.

* * * * *